US010610733B2

(12) United States Patent
Pendergast et al.

(10) Patent No.: US 10,610,733 B2
(45) Date of Patent: Apr. 7, 2020

(54) SMART WEIGHT-LIFTING PIN

(71) Applicant: uBody, Inc., Rochester, MN (US)

(72) Inventors: Ryan Pendergast, Rochester, MN (US); Christopher Wurtz, Rochester, MN (US); Wade Beavers, Rochester, MN (US); James Michael Kozlowski, St. Paul, MN (US)

(73) Assignee: uBody, Inc., Rochester, MN (US)

( * ) Notice: Subject to any disclaimer, the term of this patent is extended or adjusted under 35 U.S.C. 154(b) by 130 days.

(21) Appl. No.: 15/910,487

(22) Filed: Mar. 2, 2018

(65) Prior Publication Data

US 2018/0250553 A1 Sep. 6, 2018

Related U.S. Application Data

(60) Provisional application No. 62/466,920, filed on Mar. 3, 2017.

(51) Int. Cl.

| | |
|---|---|
| ***A63B 24/00*** | (2006.01) |
| ***A63B 21/062*** | (2006.01) |
| *A63B 71/06* | (2006.01) |
| *A63B 71/00* | (2006.01) |
| *A63B 21/072* | (2006.01) |

(52) U.S. Cl.

CPC ..... *A63B 24/0003* (2013.01); *A63B 21/063* (2015.10); *A63B 21/0726* (2013.01); *A63B 24/0062* (2013.01); *A63B 71/0036* (2013.01); *A63B 2071/068* (2013.01); *A63B 2220/16* (2013.01); *A63B 2220/40* (2013.01); *A63B 2220/52* (2013.01); *A63B 2220/803* (2013.01); *A63B 2225/20* (2013.01); *A63B 2225/50* (2013.01); *A63B 2225/52* (2013.01)

(58) Field of Classification Search

CPC ..... A63B 21/063; A63B 21/0726; A63B 24/0003; A63B 24/0062; A63B 2071/068; A63B 2071/0036; A63B 2220/16; A63B 2220/52; A63B 2220/803; A63B 2220/40; A63B 2225/20; A63B 2225/52

See application file for complete search history.

(56) References Cited

U.S. PATENT DOCUMENTS

| | | | | |
|---|---|---|---|---|
| 4,907,795 | A | 3/1990 | Shaw et al. | |
| 6,669,600 | B2 | 12/2003 | Warner | |
| 9,468,793 | B2 | 10/2016 | Salmon et al. | |
| 2005/0272561 | A1 | 12/2005 | Cammerata | |
| 2018/0200561 | A1* | 7/2018 | Chen | A63B 21/0622 |
| 2018/0345080 | A1* | 12/2018 | Orfield | A63B 24/0062 |
| 2019/0015694 | A1* | 1/2019 | Klinghult | H04Q 9/00 |
| 2019/0160335 | A1* | 5/2019 | Bengtsson | A63B 24/0087 |

FOREIGN PATENT DOCUMENTS

| | | |
|---|---|---|
| WO | 2016037012 | 3/2016 |

* cited by examiner

*Primary Examiner* — Megan Anderson

(74) *Attorney, Agent, or Firm* — Schwegman Lundberg & Woessner, P.A.

(57) ABSTRACT

Generally discussed herein are devices, systems, and methods for smart weight-lifting devices. A weight-lifting pin may be configured for insertion into a weight plate of a weight-lifting machine, the weight-lifting pin comprising a radio transmitter, a movement sensor, and a distance sensor.

18 Claims, 13 Drawing Sheets

SMART WEIGHT-LIFTING PIN

PRIORITY APPLICATION

This application claims priority to U. S. Provisional Application Ser. No. 62/466,920, filed Mar. 3, 2017, the disclosure of which is incorporated herein in its entirety by reference.

BACKGROUND

A common scene in a fitness gym may include a person carrying a pen and paper and recording their lifted weight, repetitions (reps), sets, type of lift, date, time, body weight, or the like. However, many people may not have the time or personal drive to create such records, even though they know they could benefit from such records.

DETAILED DESCRIPTION

Figure 1:
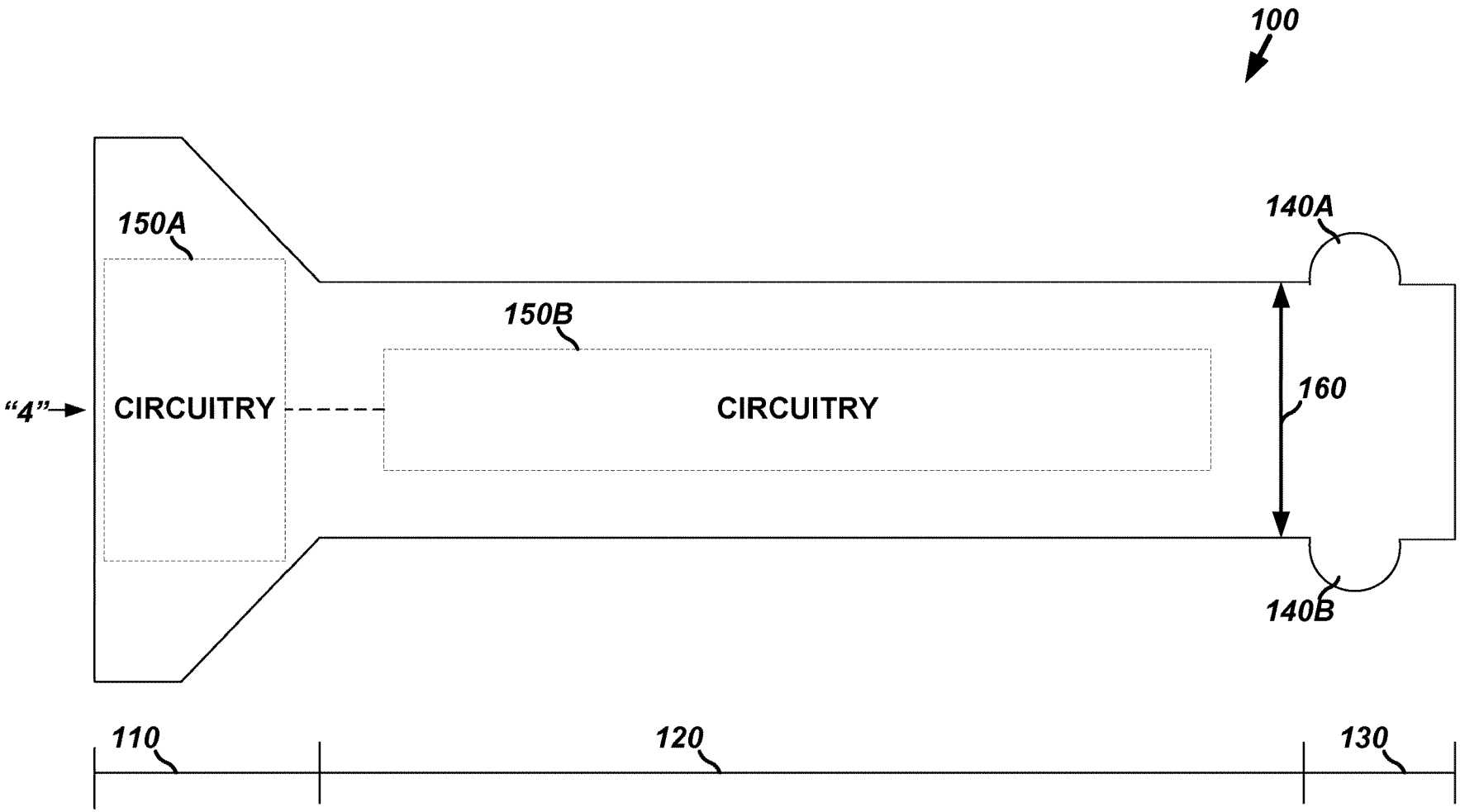
FIG. 1 illustrates, by way of example, a perspective view diagram of an embodiment of a weight-lifting pin.

In the following description, reference is made to the accompanying drawings that form a part hereof, and in which is shown by way of illustration specific embodiments which may be practiced. These embodiments are described in sufficient detail to enable those skilled in the art to practice the embodiments. It is to be understood that other embodiments may be utilized and that structural, logical, and/or electrical changes may be made without departing from the scope of the embodiments. The following description of embodiments is, therefore, not to be taken in a limited sense, and the scope of the embodiments is defined by the appended claims.

The operations, functions, or algorithms described herein may be implemented in software, hardware, firmware, or a combination thereof in some embodiments. The software may include computer executable instructions stored on computer or other machine-readable media or storage device, such as one or more non-transitory memories or other type of hardware-based storage devices, either local or networked. Further, such functions may correspond to subsystems, which may be software, hardware, firmware or a combination thereof. Multiple functions may be performed in one or more subsystems as desired, and the embodiments described are merely examples. The software may be executed on a digital signal processor, ASIC, microprocessor, central processing unit (CPU), graphics processing unit (GPU), field programmable gate array (FPGA), or other type of processor operating on a computer system, such as a personal computer, server, phone (e.g., smart phone), or another computer system, turning such computer system into a specifically programmed machine. The functions or algorithms may be implemented using processing circuitry, such as may include electric and/or electronic components (e.g., one or more transistors, resistors, capacitors, inductors, amplifiers, modulators, demodulators, antennas, radios, regulators, diodes, oscillators, multiplexers, logic gates, buffers, caches, memories, or the like).

Discussed herein are embodiments that may include automatically (e.g., without human interference after deployment) assist a person in performing a weight-lifting activity, recording details regarding the weight-lifting performed by the person, and/or providing a report regarding the weight-lifting activity. One or more embodiments may include a pin configured to be inserted in a hole in a weight plate, where the weight plate is part of a weight stack within a weight machine. The pin may be similar in dimension to current pins. The pins discussed herein may include circuitry thereon or at least partially therein. The circuitry may be configured to monitor a person's weight-lifting activities (e.g., patterns, habits), interpret and/or record outputs from one or more sensors of the circuitry, and provide feedback to the person, such as while the person performs their workout or after a portion of the workout or the entire workout is complete. Data from the pin may help in tracking more than just the lifts done, but also how they were done. This data may be used to determine how a user may change these pattern(s)/habit(s) over time, such as to get a more efficient workout. The pin may be able to determine (through weight, movement, and/or distance sensors) an amount of force being generated by a user, such as may be used to determine consistency and/or whether a user is reaching a point of fatigue, such as to help prevent injury.

One or more embodiments may include a free-weight, weight bar, and/or weight rack that includes circuitry thereon or therein. The circuitry may be configured to provide feedback to the person, such as while the person performs their workout or after a portion of the workout or the entire workout is complete.

FIG. 1 illustrates, by way of example, a perspective view diagram of an embodiment of a weight-lifting pin 100. The pin 100 as illustrated includes a head portion 110, a body portion 120, a tail portion 130, retainers 140A and 140B, and circuitry 150A and 150B. The head portion 110 is the portion of the pin 100 that extends beyond a footprint of a weight plate. The head portion 110 is generally within view of a person using the pin 100, when the pin 100 is situated in the weight plate. The body portion 120 is the portion of the pin 100 that is situated within the weight plate when the pin 100 is fully inserted into the weight plate. The tail portion 130 is the portion of the pin 100 that helps hold the pin place. The tail portion 130 may extend beyond the footprint of the weight plate or be situated within the footprint of the weight plate when fully inserted. The tail portion 130 is generally out of view of a person using the pin 100, when the pin 100 is inserted into the weight plate. The tail portion 130 is on a first side of the body portion 120 and the head portion 110 is on a second side of the body portion 120, opposite the first side of the body portion.

The body portion 120 may include a dimension, indicated by arrow 160, that allows the pin 100 to be inserted in a hole in the weight plate. The dimension may correspond to a weight plate hole diameter (in the case of a circular body portion), width and/or height (in the case of a rectangular, square, or other shape body portion), or the like. The dimension may be less than a corresponding dimension of an opening in the weight plate to allow for easy insertion of the pin 100 into the weight plate.

The retainers 140A-B may help prevent the pin 100 from slipping out of the weight plate. The retainers 140A-B may extend a dimension of the tail portion to be greater than the corresponding dimension of the hole in the weight plate. The retainers 140A-B may be rigid or may include a movable portion, such as a spring-loaded detent. The retainers 140A-B may include a sensor used to detect when the pin 100 is in the process of being inserted into a weight machine, is in the process of being removed from a weight machine, or is at rest within a weight machine. For example, a weight machine plate may include a ring to receive spring-loaded retainers 140A-B, and the geometry of the weight plate ring may cause spring-loaded retainers 140A-B to be partially depressed to indicate the pin 100 is at rest within the weight plate. All or a portion of the weight plate may thus reside between the head portion 110 and the tail portion 130 when the pin 100 is fully inserted into the weight plate. The circuitry 150A-B may include electric and/or electronic components configured to create and/or interpret data indicative of a workout performed using the pin 100. Examples of the circuitry 150A-B are shown in FIG. 2.

Figure 2:
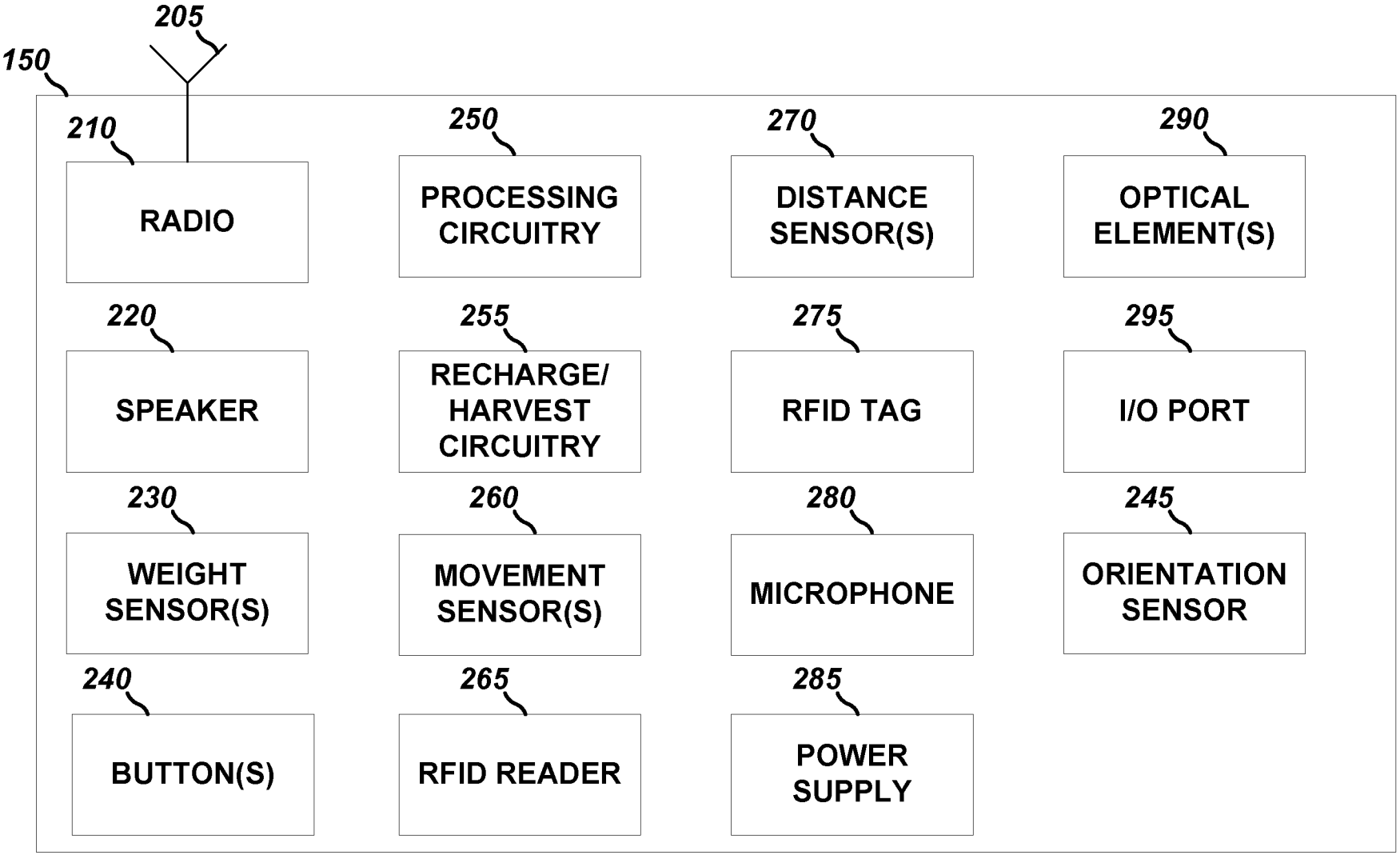
FIG. 2 illustrates, by way of example, an exploded view diagram of an embodiment of circuitry, such as may be included in a weight-lifting device.

FIG. 2 illustrates, by way of example, an exploded view diagram of an embodiment of circuitry 150. The circuitry 150A-B may include one or more components shown within circuitry 150. One or more components of the circuitry 150A-B may be situated at least partially within the pin 100, as indicated by the dashed lines surrounding 150A and 150B. One or more components of the circuitry 150A-B may be situated on or be at least partially external to the pin 100. One or more components of the circuitry 150 may be situated at least partially within the pin 100 and may be visible outside the pin 100.

The circuitry 150 as illustrated includes components including an antenna 205, radio 210, speaker 220, weight sensor(s) 230, button(s) 240, orientation circuitry 245, processing circuitry 250, recharge/harvest circuitry 255, movement sensor(s) 260, radio frequency identification (RFID) reader 265, distance sensor(s) 270, RFID tag 275, microphone 280, a power supply 285, optical element(s) 290, and I/O port(s) 295. Each of the components may be electrically coupled or connected to any of the other components, such as through a trace, bus, pad, electrical pin, via, and/or other electrical connection circuitry.

The antenna 205 may include a loop, monopole, dipole, coil, slot, or other antenna. An antenna converts electromagnetic waves into electrical signals and vice versa. The antenna 205 receives electromagnetic waves and provides corresponding electrical power to the radio 210 and/or receives electrical power from the radio 210 and radiates corresponding electromagnetic waves to an environment external to the antenna 205.

The radio 210 generates electrical signals (i.e., by modulating electrical power to embed data), and uses antenna 205 to generate corresponding electromagnetic waves. Radio 210 may also demodulate electrical signals provided by the antenna 205 to determine the data carried on a corresponding electromagnetic wave. The radio 210, in one or more embodiments, may be configured as a Bluetooth®, Zigbee, Z-Wave, Wi-Fi, Cellular, Near Field Communication (NFC), Sigfox, LoRaWAN, or other protocol radio. In one or more embodiments, the radio 210 may be configured to operate in accord with a standard, such as one or more standards of an Institute of Electronic and Electrical Engineers (IEEE) 802 family of standards, or the like. The radio 210 may be configured to provide data, such as in one or more communications or packets, to a device external to the pin 100. The radio 210 may be configured to receive data that may be provided to one or more of the other components of the circuitry 150.

The speaker 220 is a transducer that converts electrical power into audio signals. The speaker 220 may provide one or more sounds to the user, such as a beep, word, song, or other sound, that aid the user in the using the pin 100 and/or performing their workout. Electrical power to be converted to audio may be provided to the speaker 220 from the processing circuitry 250. The speaker 220 may, for example, provide one or more of the following sounds: (1) a first sound indicating that the pin 100 is to be calibrated, (2) a second sound indicating that calibration of the pin 100 is complete, (3) a third sound indicating that a weight needs to be determined, (4) a fourth sound indicating that the weight is determined, (5) a fifth sound indicating that reps, amount of extension, or the like has begun being recorded, (6) a sixth sound indicating that the reps, amount of extension, or the like has finished being recorded, (7) a seventh sound indicating that the person is performing a workout motion too fast, (8) an eighth sound indicating that the person is not extending/flexing enough in performing a workout motion, (9) a ninth sound indicating that the amount of weight detected is greater than or less than expected based on a weight training schedule programmed into the processing circuitry 250, or the like. The sounds may be the same and/or different sounds.

The weight sensor(s) 230 may include one or more piezoelectric elements (piezoelectric deflection detector, piezoelectric compression detector), strain gauge, hydraulic, pneumatic, capacitive, or another load cell. The weight sensor(s) 230 produce data that can be used, such as by the processing circuitry 250, to determine a weight of an object putting force on the pin 100. For example, the weight sensor(s) 230 may determine weight as a function of detected force or pin deflection, such as by detecting displacement of a simply-supported cantilever beam. The weight sensor(s) 230 may detect acceleration based on a change in detected force, where the acceleration may be used in conjunction with or in place of movement sensor(s) 260. The weight sensor(s) 230 may be placed at one or more locations on, or at least partially in, the body portion 120 of the pin 100.

The button(s) 240 may include one or more tactile or touch screen buttons. In embodiments in which the button(s) 240 are touch screen buttons, the buttons 240 may be part of the optical element(s) 290. The button(s) 240 may include one, two, three, four, five, six, seven, eight, nine, ten, etc. button(s). The button(s) 240, when actuated, may close a circuit that provides one or more electrical signals to the processing circuitry 250. The processing circuitry 250 may receive the one or more signals and perform an operation based on the received signal. The button(s) 240, whether tactile or touch screen, may include indicia thereon to indicate an operation performed in response to the button being activated or to otherwise distinguish the button(s) 240 from one another. The button(s) 240 may include a button that, when actuated, closes a circuit that provides power from the power supply 285 to the component(s) coupled or connected thereto and, when de-actuated, opens the circuit that provides power from the power supply 285 to the component(s). Other operation(s) that may be performed using the button(s) 240 are discussed elsewhere herein.

The orientation sensor(s) 245 provide data indicating an orientation or rotation of the pin 100 relative to the ground. The orientation sensor(s) 245 may include a three-axis accelerometer, a gyroscopic sensor, or the like. A three-axis accelerometer may determine an orientation of the pin 100 relative to the ground by determining the direction of the gravitational acceleration. A gyroscopic sensor may include a spinning wheel or disc in which an axis of rotation is free to assume any orientation, where the spinning wheel is used to detect a change in orientation. Gyroscopic sensors may be based on other architectures, such as microelectromechanical system (MEMS) devices gyroscopes, solid-state lasers, fiber optic, or the like. The processing circuitry 250 may determine an orientation of the pin 100 based on the data from the orientation sensor(s) 245, the movement sensor(s) 260, and/or the distance sensor(s) 270. In one or more embodiments, the processing circuitry 250 combines data from one or more sensors to provide an improved estimation of the orientation or location of the pin 100, such as by using Kalman filtering or other linear quadratic estimation techniques. The processing circuitry 250 may cause the speaker 220 to produce a sound, the optical element(s) 290 to produce a light, or the radio 210 to produce a communication indicating that the pin 100 is or is not properly oriented based on the data from the orientation sensor(s) 245, the movement sensor(s) 260, and/or the distance sensor(s) 270.

The recharge/harvest circuitry 255 helps provide electrical energy to recharge the power supply 285 and/or provide power to one or more of the components of the circuitry 150. Energy harvesting circuitry derives electrical energy from solar, thermal, wind, kinetic, electromagnetic, or other external sources of energy. Energy harvesting circuitry includes one or more components to accumulate, store, and/or provide electrical energy. Recharging circuitry includes electrical or electronic components that, when coupled to a power supply, provide electrical energy for circuitry 150 or for charging a power supply of another device.

The movement sensor(s) 260 may include one or more accelerometers, such as a capacitive and/or piezoelectric accelerometer. A capacitive accelerometer produces a voltage based on a distance between two conductive surfaces. A piezoelectric accelerometer accumulates charge on a compressed crystal, where the charge is provided as a current or voltage. The movement sensor(s) 260 provide data indicative of whether the pin 100 is in motion and/or a direction in which the pin 100 is moving or accelerating. The direction may include one, two, or three directions (e.g., a one-axis, two-axis, or three-axis accelerometer). Acceleration detected by the movement sensor(s) 260 may be combined with acceleration detected by weight sensor(s) 230, such as using a Kalman filter or other state variable estimation techniques. The processing circuitry 250 may interpret output of the movement sensor(s) 260 to determine a number of repetitions performed, a distance the pin 100 traveled during a repetition, a speed at which the pin 100 traveled, or the like.

The RFID reader 265 may be an active reader or a passive reader. A passive reader 265 receives radio signals from an active RFID tag. An active reader transmits interrogator signals and receives authentication replies from passive RFID tags. The RFID reader 265, in active embodiments, provides an encoded RF signal to interrogate the RFID tag 275.

The distance sensor 270 may include a sound (e.g., ultrasonic), optical (e.g., infrared), or other distance sensor. An ultrasonic distance sensor provides an ultrasonic wave and uses a reflection of the ultrasonic wave to provide data indicative of a distance to a nearest object. Similarly, an infrared distance sensor provides an optical wave within an infrared frequency range and uses a reflection of the optical wave to provide data indicative of distance to a nearest object. In one or more embodiments, the distance sensor 270 may be situated in the head portion 110 and exposed to the environment external to the pin 100. The distance sensor 270 may be pointed at the ground or pointed at an object above the pin 100. The pin 100 may include an offset mass 370 (see FIG. 3) to promote or require the pin 100 to maintain a preferred orientation, where the preferred orientation includes the distance sensor 270 pointed at the ground or pointed at an object above the pin 100 and/or the weight sensor(s) 230 situated relative to the weight plate(s). The distance data provided by the distance sensor 270 may be provided to the processing circuitry 250, so that the processing circuitry 250 may determine a number of repetitions, a distance the pin 100 traveled during a rep, a speed at which the pin 100 traveled, a plate in which the pin 100 is situated (see FIG. 11), or the like.

The RFID tag 275 may include a passive tag, an active tag, or a battery-assisted passive tag. An active tag includes an onboard power supply (e.g., the power supply 285). A battery-assisted passive tag has a battery onboard and is activated when in the presence of the RFID reader 265. A passive tag uses radio energy from the RFID reader 265 in harvesting energy for transmitting an RF signal. The RFID tag 275 is attached to an object to be identified. The RFID reader 265, such as an active RFID reader, may provide a signal to the RFID tag 275. RFID tags usually include an integrated circuit, such as for storing and processing information, modulating and/or demodulating RFID signals, and/or collecting power from an incident signal from the RFID reader 265. The RFID tag 275 may respond to the interrogation signal from the RFID reader 265 with identification information and/or other data regarding the object to which the RFID tag 275 is attached.

The microphone 280 is a transducer that converts sound energy into electrical energy. A user may speak into the microphone 280 to cause one or more components of the circuitry 150 to perform an operation. For example, the processing circuitry 250 may be configured to cause one or more of the following operations to occur in response to electrical energy provided from the microphone 280: (1) begin monitoring data from the weight sensor(s) 230 and determine a weight; (2) begin monitoring data from the movement sensor(s) 260 to determine a number of reps, distance the pin 100 traveled, speed at which the repetition occurred, or the like; (3) begin monitoring data from the distance sensor(s) 270 to determine a number of reps, distance the pin 100 traveled, speed at which the repetition occurred, or the like; (4) determine a type of lift associated with a rep, set, weight, or the like; (5) determine a user associated with a lift, rep, set, weight, workout, or the like; (6) determine one or more characteristic(s) of a user (e.g., height, weight, age, gender, or the like); and (7) perform a program stored in a memory of the processing circuitry 250.

The power supply 285 provides electrical power to components of the circuitry 150 that use power to operate, such as the antenna 205, radio 210, speaker 220, weight sensor(s) 230, processing circuitry 250, movement sensor(s) 260, distance sensor(s) 270, microphone 280, optical element(s) 290, and/or an item coupled to the I/O port 295. In one or more embodiments, the power supply 285 may include a battery, such as may be internal or external to the pin 100. In one or more embodiments, the power supply 285 may be coupled to an electrical outlet or other power source external to the pin 100.

The optical elements 290 are transducers that convert electrical energy to optical energy. The optical elements 290 may be a part of a touch screen, liquid crystal display (LCD), and/or include one or more light emitting diodes (LEDs), or other optical transducers. The optical element(s) 290 may provide an indication, such as by flashing, blinking, emanating optical energy of a specific frequency, such as to convey a specific color, or the like. The optical element 290 may be used to indicate (1) the pin 100 is to be calibrated, (2) calibration of the pin 100 is complete, (3) that a weight is to be determined, (4) that the weight is determined, (5) that reps, amount of extension, or the like has begun being recorded, (6) that the reps, amount of extension, or the like has finished being recorded, (7) that the person is performing a workout motion too fast, (8) that the person is not extending/flexing enough in performing a workout motion, (9) that the amount of weight detected is greater than or less than expected based on a weight training schedule programmed into the processing circuitry 250, or the like.

The I/O port 295 may be configured as a Lightning connector, universal serial bus (USB), Ethernet, FireWire, serial AT attachment (SATA), external SATA (eSATA), thunderbolt, or other port. The I/O port 295 may facilitate data transfer to and/or from the pin 100. Data may be provided from the pin 100 to an external device through the radio 210 and/or the I/O port 295, depending on the configuration of the pin 100. The radio 210 (via the antenna 205) or the I/O port 295 may provide data regarding one or more workout(s) recorded on a memory of the processing circuitry 250. In one or more embodiments, the power supply 285 may be charged or the pin 100 may be powered, using the I/O port 295, such as by connecting a USB cable or a power cable to the I/O port 295 that is also connected to a device that may provide power. In one or more embodiments, the I/O port may include a dedicated charge port, such as may receive a direct current (DC) adapter input capable of charging the power supply 285 when connected to external power. The pin 100 may be coupled to a server, to another weight machine, or to the like through the I/O port 295.

The I/O port 295 may be configured to have a cable attached thereto. The cable may be weighted, coiled, or otherwise configured to provide force on the pin 100 that orients the pin 100 in a desired orientation. In one or more embodiments, the pin may be used to orient the weight sensor(s) 230A-B relative to a weight plate, to orient the movement sensor(s) 260 relative to a floor of a building, and/or to orient the distance sensor(s) 270 relative to an object (the ground, ceiling, or other object).

The processing circuitry 250 may include a hardware processor, such as a microcontroller, central processing unit (CPU), graphics processing unit (GPU), field programmable gate array (FPGA), application specific integrated circuit (ASIC), or the like, that is configured to perform operations of the processing circuitry 250. The processing circuitry 250 may, additionally or alternatively, include electric and/or electronic components (e.g., one or more transistors, resistors, capacitors, inductors, amplifiers, modulators, demodulators, antennas, radios, regulators, diodes, oscillators, multiplexers, logic gates, buffers, caches, memories, or the like) configured to perform operations of the processing circuitry 250. The processing circuitry 250 may be configured as a state machine that includes combinational logic that receives input(s), alters state based on the input(s), and produces output(s) based on the input(s) and/or the state.

The processing circuitry 250 may perform operation(s) for monitoring a workout, such as may include: (1) determining and/or recording a weight based on data provided from the weight sensor(s) 230; (2) determining a number of reps based on data provided from the distance sensor(s) 270 and/or movement sensor(s) 260; (3) causing the optical element(s) 290 to change color and/or blink rate or indicate to the person using the pin 100 an operation to be performed or being performed by the processing circuitry 250; (4) causing the speaker 220 to produce sound, such as to indicate an action to be performed by the person and/or an operation to be performed or being performed by the processing circuitry 250; (5) determining whether the person performing the workout is extending/flexing a sufficient amount; (6) determining whether the person performing the workout is performing a lift too fast, too slow, or the like; (7) causing the optical element(s) 290, radio 210, and/or speaker 220 to indicate a number of reps remaining in a current set and/or a number of sets completed or remaining in the workout; (8) loading and/or executing a workout program based on data provided from the button(s) 240, speaker 220, and/or radio 210; (9) providing data from a memory of the processing circuitry 250 in response to a device being connected to the I/O port 295 or through the radio 210; (10) determining calibration data for a full extension/flexion, weight determination, or the like; (11) determining an amount of force generated by a user, such as may be based on data from the weight sensor(s) 230, movement sensor(s) 260, and/or distance sensor(s) 270; (12) determining when a user is fatigued or nearly fatigued, such as to determine how may reps until failure or to help prevent injury, or (13) determining a type of lift being performed by the person, such as by prompting the person through a communication from the radio 210, speaker 220, and/or optical elements 290.

The processing circuitry 250 may be configured to determine an estimate of the weight on the pin 100. A person may be instructed, through the speaker 220, radio 210, and/or optical element(s) 290 to insert the pin 100 into a stack of weights, lift the stack of weights, and hold the pin 100 and stack steady for a specified amount of time, and/or when the weight determination is complete. The pin 100 may prompt the person, such as through the optical element(s) 290, speaker 220, and/or communication through the radio 210 for an amount of weight the person would expect the pin 100 register. The processing circuitry 250 may record at least a portion of the output of the weight sensor(s) 230 and/or a value of weight as indicated by the person. This data may be used for determining the weight of an object on the pin 100 in the future and/or for providing workout data.

The weight determined by the processing circuitry 250, based on data from the weight sensor(s) 230, may be quantized, such as to common units of weight plates within weight machine stacks. For example, the processing circuitry 250 may round the determined weight to the nearest pound, five pounds, or the like. In an example in which the person is using a weight-lifting machine, the weight-lifting machine will likely include weights in five or ten-pound increments, thus a five or ten-pound resolution in the determined weight may be sufficient in this example.

Reps may be determined by monitoring the output of the distance sensor(s) 270 and/or movement sensor(s) 260. For example, the processing circuitry may determine that a rep is completed when the data from the distance sensor(s) 270 reads within a threshold value of an initial value. The initial value may be recorded in response to a user beginning a set or rep. The data from the distance sensor(s) 270 may be monitored to determine when the data reads a same value as the initial value (to within a threshold difference) indicating that the pin 100 has returned to near its initial location.

Data from the movement sensor(s) 260 may, additionally or alternatively, be used to determine reps. The data from the movement sensor(s) 260 may indicate acceleration(s), direction(s) of acceleration(s), and/or time(s) of acceleration(s). The processing circuitry 250 may determine a position based on the following formula: position=initial position+speed*time+0.5*acceleration*(time$^2$). Variations of this formula may be used depending on the availability of data from the distance sensor(s) 270 and/or movement sensor(s) 260. Since the initial position is generally arbitrary, it may be set to zero and the processing circuitry 250 may determine when the position (based on the acceleration data) is determined to be within a threshold position of zero.

In one or more embodiments, a rep may be determined by having the person perform a specified number of reps, recording the data produced by one or more of the movement sensor(s) 260 and/or distance sensor(s) 270, and comparing output of the movement sensor(s) 260 and/or distance sensor(s) 270 to the recorded data. If a distance between the recorded data and the data from the movement sensor(s) 260 and/or distance sensor(s) 270 is less than a specified threshold, as determined by the processing circuitry 250, the processing circuitry 250 may determine that a rep has occurred. Such embodiments may help encourage repeatable form, speed, extension/flexion or the like.

The processing circuitry 250 may be configured to perform one or more programs of a plurality of programs. A program may include one or more lifts, a weight associated with each lift, a number of reps for each lift, time between sets, and/or other weight-lifting program data. The program performed by the processing circuitry 250 may be selected, by the person, through data provided to the processing circuitry 250 through the button(s) 240, the microphone 280, and/or radio 210. For example, a program may be created for each day of the week the person lifts weights. Consider an example in which a person lifts weights four days a week, Monday, Tuesday, Thursday, and Friday. A program may be created for each of the days. Each program may include lifts, corresponding sets, corresponding reps, weight, time between sets, order of lifts, flexion/extension, and/or the like for each lift. The person may indicate to the processing circuitry 250 which program is to be run or the processing circuitry 250 may determine what program is to be run based on a day of the week (as determined by a clock or timer of the processing circuitry 250 or by querying a device coupled to the processing circuitry 250 through the radio 210).

The processing circuitry 250 may receive data from the RFID reader 265 indicating an identification associated with an RFID tag 275 that was detected by the RFID reader 265. The processing circuitry 250 may use the RFID identification to identify (e.g., look up in a memory of the processing circuitry 250), a lift, weight, time, program, calibration curve, or the like associated with the person corresponding to the RFID identification. The processing circuitry 250 may determine that a calibration curve or other data may be needed for proper monitoring of the workout of the person.

Using one or more of the button(s) 240, microphone 280, optical element(s) 290, RFID tag 275, and/or RFID reader 265 a user may check in to a weight lifting device and/or check out of a weight lifting device. Data collected while a user is checked in to the device may be associated with the user checked in. In one or more embodiments, a user may be checked out automatically by a specified period of time elapsing without one or more of the components of the circuitry detecting a change. In one or more embodiments, a user may be checked out in response to another user checking in to the smart weight lifting device.

The association of a user to the smart weight lifting device may help allow a data monitoring system to uniquely identify a session (e.g., workout, specific reps, specific set, or the like). This identification may be associated with user data, such as data sent to a server, base station, and/or end user. This data may be used (e.g., in the cloud) for later consumption/analytics of data. For example, at the end of a rep session, set session, or workout, the collected data may be sent to the server 818 (see FIG. 8), associated with the user identification, and analyzed for performance relative to the user's profile or previously collected data.

Figure 3:
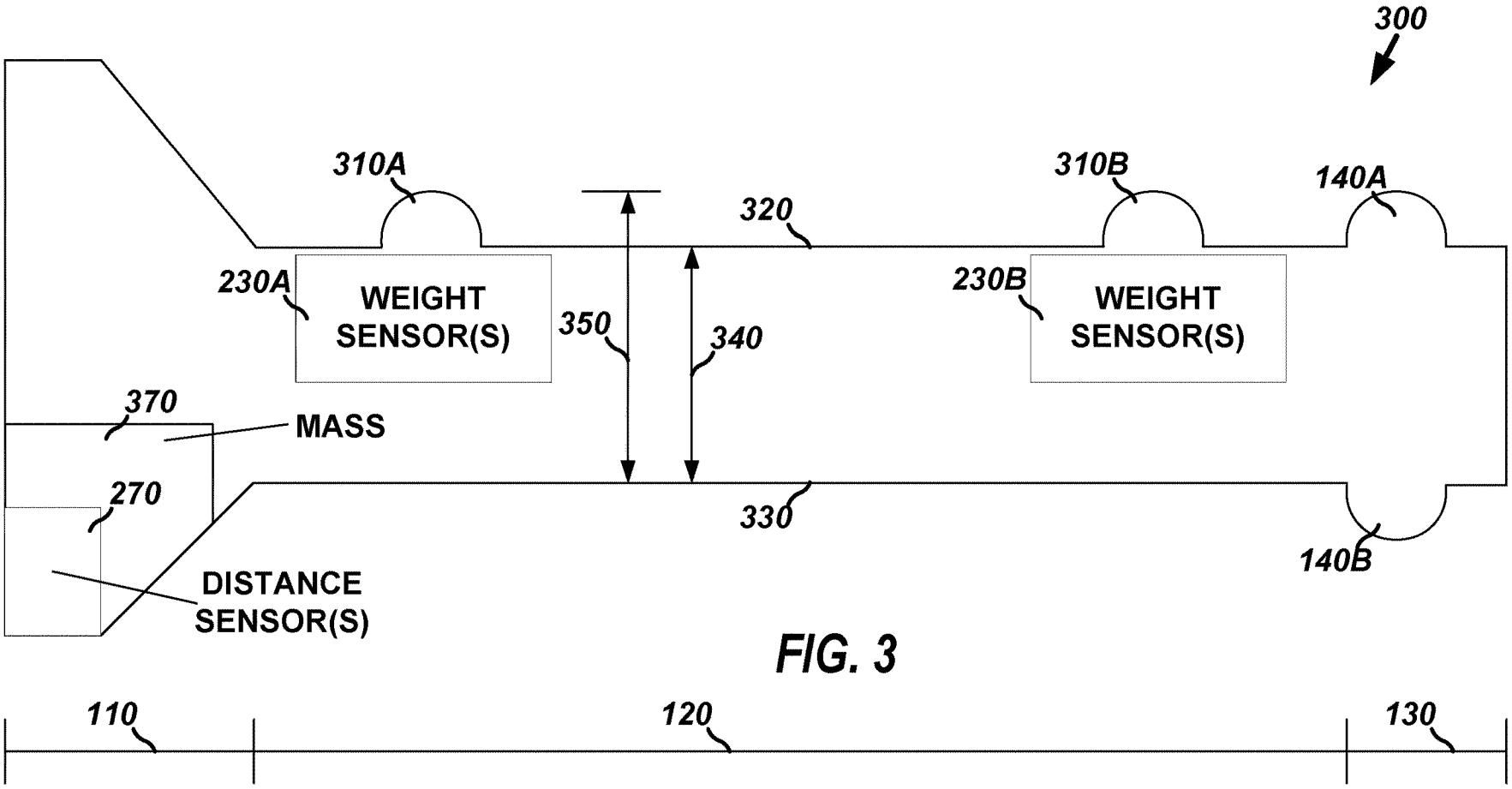
FIG. 3 illustrates, by way of example, a cross-section diagram of an embodiment of a smart pin.

FIG. 3 illustrates, by way of example, a cross-section diagram of an embodiment of a smart pin 300. The pin 300 may include one or more components of the circuitry 250. The components illustrated in the cross-section shown include weight sensor(s) 230A and 230B and the distance sensor(s) 270. The weight sensor(s) 230A-B are specific embodiments of the weight sensor(s) 230.

The weight sensor(s) 230A-B may be situated on (in mechanical contact with) or near protrusions 310A and 310B. The protrusions 310A-B may extend beyond a dimension (indicated by arrow 340) of the body portion 120. The distance from a first side 330 to of the pin 300 to an outermost portion of the protrusion 310A-B is indicated by arrow 350. The distance indicated by the arrow 350 is less than a corresponding dimension of a weight plate in which the pin 300 is to be situated. The protrusions 310A-B allow the force of the weights on the pin 300 to be transferred to two points rather than distributed through the length of the body portion 120 (such as may happen using the pin 100). The protrusions 310A-B thus may provide a greater deflection on a strain gauge weight sensor or compression on or deflection of a piezoelectric weight sensor.

The distance sensor 270 is illustrated as being in the head portion 110. The distance sensor 270 is illustrated as facing away from a second side 320 of the body portion 120. The second side 320 is opposite the first side 330. The distance sensor 270 may be exposed (at least partially) to an environment external to the pin 300, such as to allow the distance sensor(s) 270 generate and emit ultrasonic or optical waves that bounce off a surface external to the pin 300 and return to the distance sensor 270.

Figure 4:
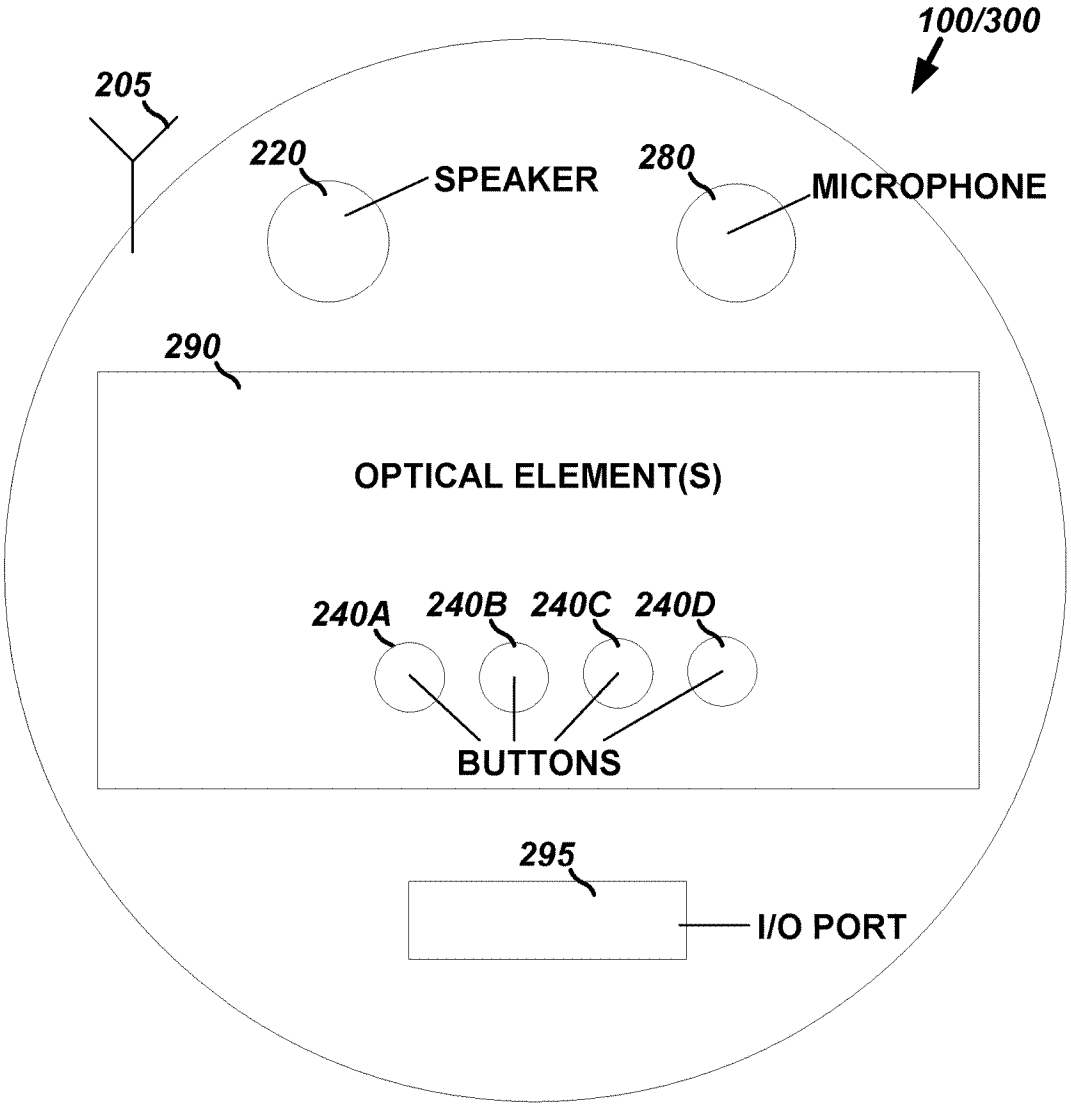
FIG. 4 illustrates, by way of example, a perspective view diagram of an embodiment of the pin of FIGS. 1 and/or 3.

FIG. 4 illustrates, by way of example, a perspective view diagram of an embodiment of the pin 100/300. The perspective provided in FIG. 4 is in the direction of arrow labelled "4" in FIG. 1. The perspective provided in FIG. 4 is of an end of the pin 100/300 that generally faces towards the person using the pin 100/300. The end illustrated in FIG. 4 is the end of the pin 100/300 in the head portion 110. Each of the components illustrated in FIG. 4 may be exposed, at least partially, to an environment external to the pin 100/300. The components as illustrated include the speaker 220, the microphone 280, the optical element(s) 290 (in the form of a touch screen that includes button(s) 240A, 240B, 240C, and 240D, that are specific embodiments of the button(s) 240), and the I/O port 295. Another component which may reside at least partially external to the pin 100/300 may include the antenna 205, such as a monopole antenna, stripline antenna, or other antenna, such as to help reduce interference with signals provided thereto or therefrom.

Figure 5:
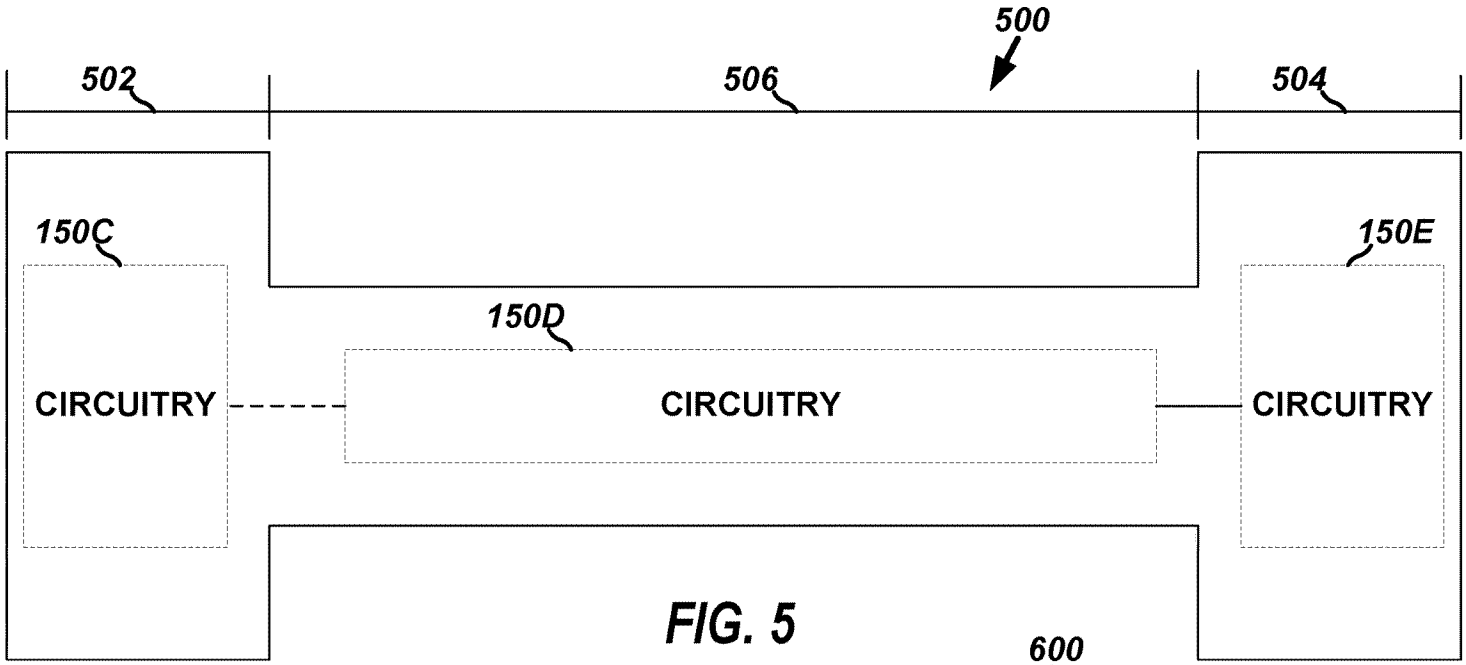
FIG. 5 illustrates, by way of example, a logical block diagram of an embodiment of a smart free weight.
Figure 6:
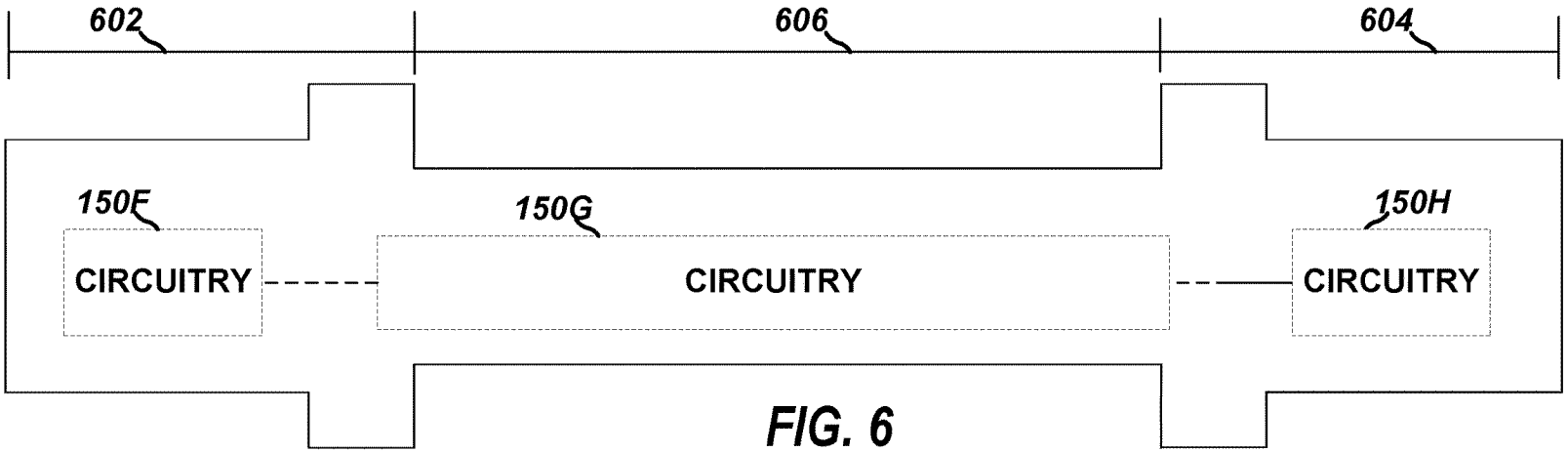
FIG. 6 illustrates, by way of example, a logical block diagram of an embodiment of a smart bar bell.
Figure 7:
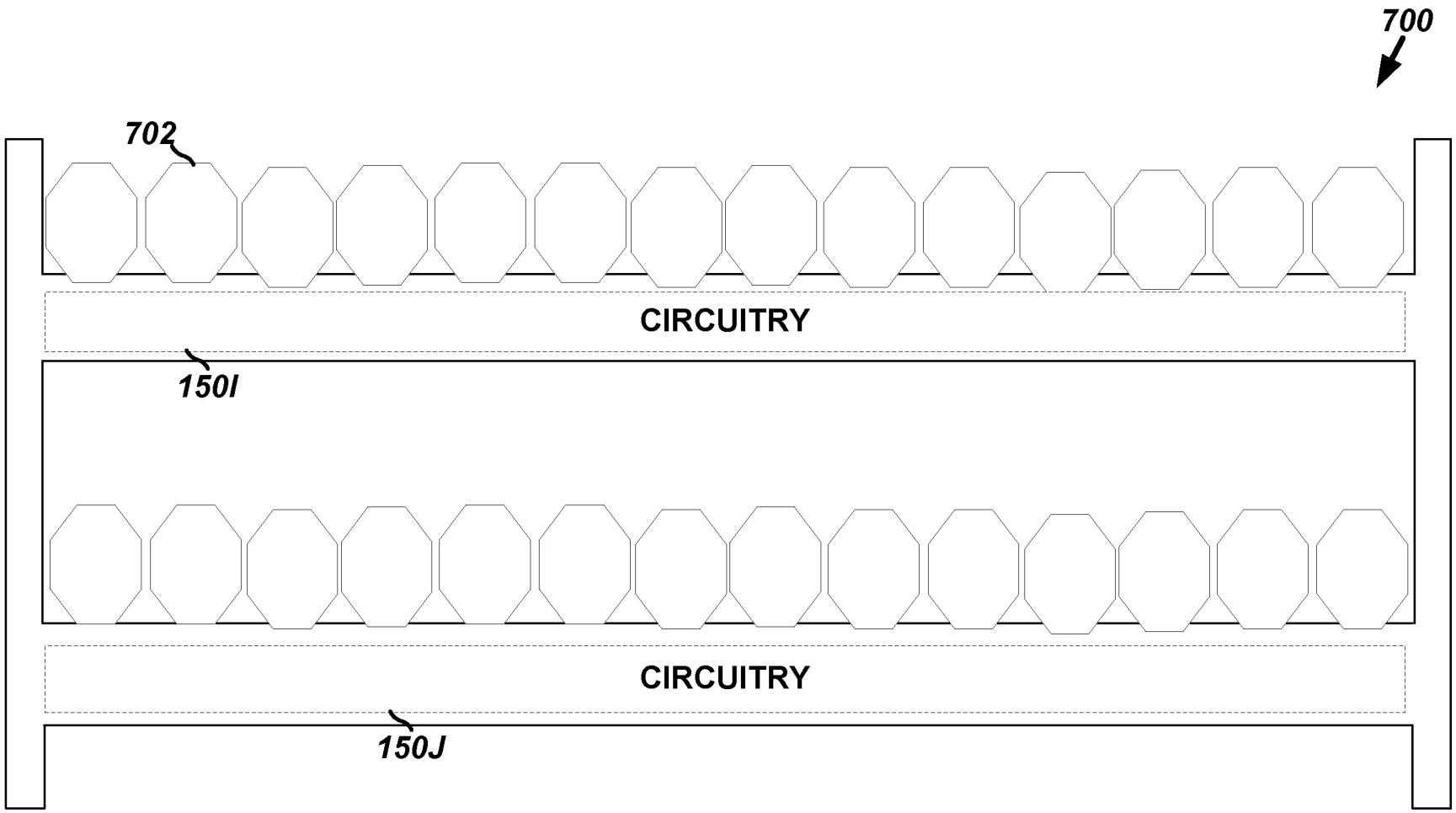
FIG. 7 illustrates, by way of example, a logical block diagram of an embodiment of a smart weight rack.

The discussion thus far has focused on a smart weight-lifting pin 100/300 and circuitry 150 that may be included at least partially therein and/or thereon. One or more of the concepts discussed herein may additionally or alternatively be applied to other weight-lifting equipment, such as a free weight (e.g., a dumb bell, kettle bell, medicine ball, or the like), a bar bell, a weight rack, or the like. FIG. 5 illustrates, by way of example, a logical block diagram of an embodiment of a smart free weight 500. FIG. 6 illustrates, by way of example, a logical block diagram of an embodiment of a smart bar bell 600. The smart bar bell 600 may be adapted to allow the user to add weight plates to each end, whereas the smart free weight 500 may include a non-removable fixed weight on both ends. FIG. 7 illustrates, by way of example, a logical block diagram of an embodiment of a smart weight rack 700. Each of the free weight 500, bar bell 600, and/or the weight rack 700 may include one or more components of the circuitry 150, such as is illustrated by specific embodiments of the circuitry 150C, 150D, 150E, 150F, 150G, 150H, 1501, and 150J. Each of the circuitry 150C-J may include one or more of the components of the circuitry 150.

The circuitry 150C-E of the free weight 500 may include an RFID tag that, when interrogated by an RFID reader, provides information indicating the weight of the free weight. The circuitry 150C may be situated in a first head portion 502 of the free weight 500, the circuitry 150D may be situated in a body portion 120 of the free weight 500, and/or the circuitry 150E may be situated in a second head portion 504 of the free weight 500. Components of the circuitry 150C-E may be configured to include one or more components discussed regarding the pin 100/300 and/or configured to perform one or more of the operations discussed regarding the pin 100/300.

The free weight 500 may include a first distance sensor (e.g., distance sensor 270) or movement sensor (e.g., movement sensor 260) in the first head portion 502 and a second distance sensor or movement sensor in the second head portion 504. Data from the first distance and/or movement sensor may be compared to data from the second distance and/or movement sensor, such as by the processing circuitry 250. The processing circuitry 250 may determine whether a person is using the free weight 500 properly. For example, if data from the sensors indicates that the head portions 502 and 504 are rotating relative to one another, the processing circuitry 250 may cause a component to alert the person using the free weight 500 that they are applying correct rotation (e.g., supination, pronation) or alert them that they are using incorrect form.

The circuitry 150F-H of the bar bell 600 may include an RFID tag that, when interrogated by an RFID reader, provides information indicating the weight of the bar bell 600. The circuitry 150F may be situated in a first head portion 602 of the bar bell 600, the circuitry 150G may be situated in a body portion 606 of the bar bell 600, and/or the circuitry 150H may be situated in a second head portion 5604 of the bar bell 600. Components of the circuitry 150F-H may be configured to include one or more components discussed regarding the pin 100/300 and/or the free weight 500, and/or configured to perform one or more of the operations discussed regarding the pin 100/300 and/or the free weight 500.

The circuitry 150I-J of the weight rack 700 may detect the presence or absence of one or more dumb bells 702 or other weights. The circuitry 150I-J of the weight rack 700 may include recharge circuitry that charges a power supply of a free weight on the weight rack 700.

Figure 8:
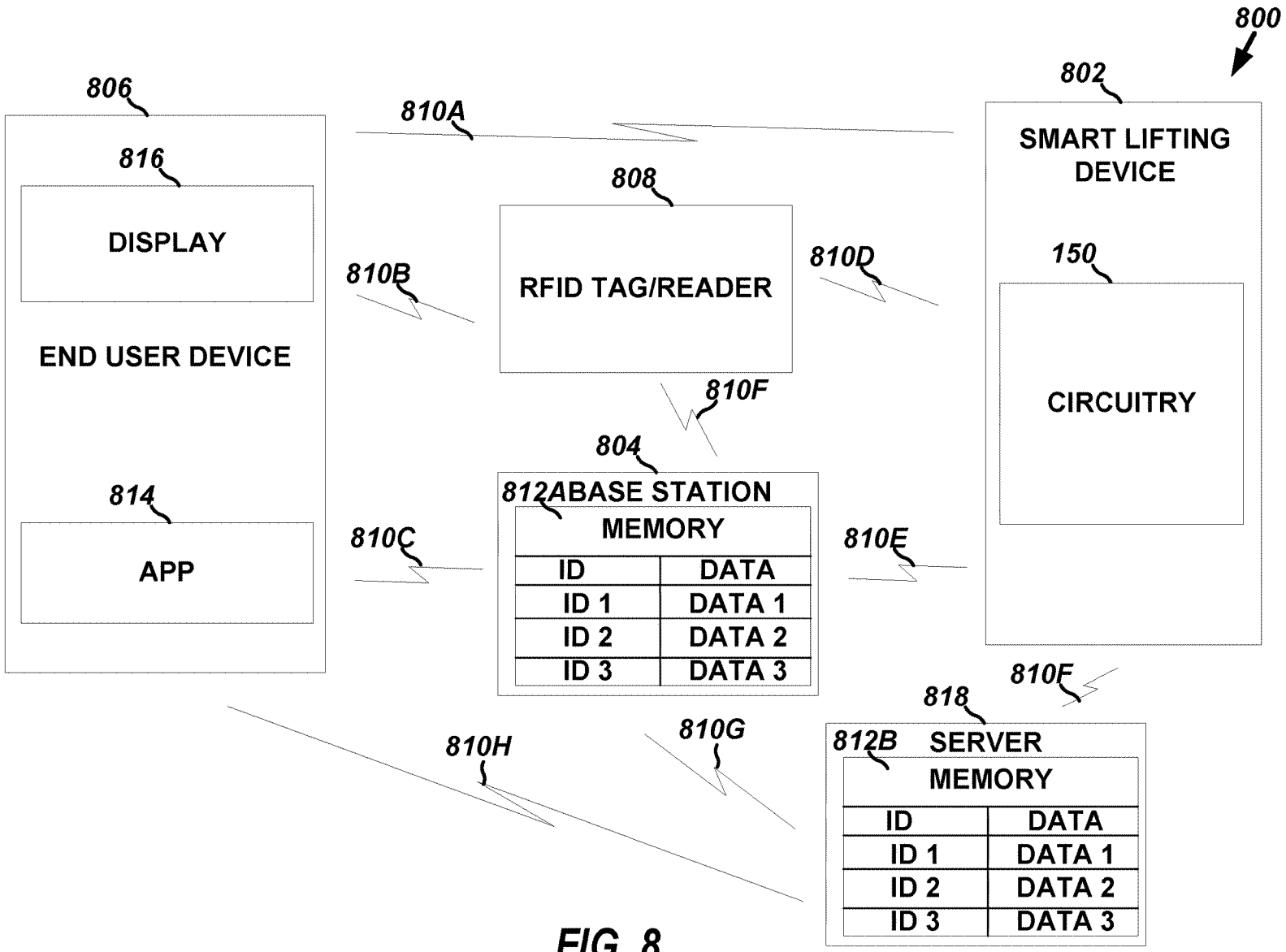
FIG. 8 illustrates, by way of example, a logical block diagram of an embodiment of a system.

FIG. 8 illustrates, by way of example, a logical block diagram of an embodiment of a system 800. The system 800 is a system for using a smart lifting device 802 (e.g., the pin 100/300, the free weight 500, the bar bell 600, and/or the rack 700). The system 800 as illustrated includes the smart lifting device 802, an optional base station 804, an optional end user device 806, a server 818, and an optional RFID tag/reader 808. Each of the smart lifting device 802, base station 804, end user device 806, and the RFID tag/reader 808 may include one or more components of the circuitry 150. The smart lifting device 802, base station 804, end user device 806, RFID tag/reader 808, and/or server 818 may be communicatively coupled through a wired or wireless communication link 810A, 810B, 810C, 810D, 810E, 810F, 810G, and/or 810H.

The smart lifting device 802 may include one or more of the pin 100/300, the free weight 500, the bar bell 600, and/or the rack 700. Each of the smart lifting devices 802, as previously discussed and illustrated in FIG. 8, may include the circuitry 150. The smart lifting device 802 may be communicatively coupled to the base station 804, end user device 806, and/or the RFID tag/reader 808.

The base station 804 may serve as an intermediary between the smart lifting device 802 and the end user device 806. The base station 804 may include a memory 812A. The memory 812A includes workout data from the circuitry 150. The base station 804 may organize the workout data by an identification of the person associated with the workout. The base station 804 may ping the smart lifting device 802 (e.g., periodically request, at fixed time intervals, or on some other schedule) for workout data. After the circuitry 150 provides the data, it may erase the data from a memory thereof, such as to free up memory space for more data on the smart lifting device 802. The base station 804 may provide workout data to the end user device 806, such as in response to receiving a request from the end user device 806 for workout data. The request may include an identification of the person associated with the workout and/or authentication information to verify that the entity requesting the workout data is authorized to receive the workout data.

The end user device 806 may include a smart phone, lap top computer, smart watch, or the like. The end user device may be communicatively coupled to the smart lifting device 802, the base station 804, and/or RFID tag/reader 808. The end user device 806 may include an app 814 stored and/or operating thereon. The app 814 may analyze and perform operations on the workout data from the smart lifting device 802 and/or base station 804 and provide analytics regarding the workout data, such as through display 816. The app 814 may provide a user interface through which a user may specify a date/range of dates, lift type, or the like, and the app 814 may provide the user of the end user device 806 with a graph, chart, table, or other view of the requested data. The app 814 may require user authentication prior to providing a user with workout data. The authentication may be provided by, for example, an RFID tag associated with the user (e.g., the RFID tag/reader 808).

The RFID tag/reader 808 may include one or more of the RFID tag 275 and RFID reader 265. The RFID tag/reader 808 may communicate with one or more of the smart lifting device 802, base station 804, and end user device 806. As previously discussed, the RFID tag/reader 808 may provide an authentication or verification of a user's identity.

The server 818 may receive data collected and/or created at the smart weight lifting device 802, the end user device 806, and/or the base station 804. The server 818 as illustrated includes a memory 812B that may include data similar to the memory 812A. The server 818 may perform data analytics on the data, such as to determine workout performance, workout habits, workout patterns, or the like, of a user of the smart weight lifting device 802. One or more of the analytics performed by the server 818 may additionally or alternatively be performed by the base station 804 and/or the end user device 806. The server 818 may be a part of a network that includes the smart lifting device 802 and/or remote to the network of the smart lifting device 802.

Figure 9B:
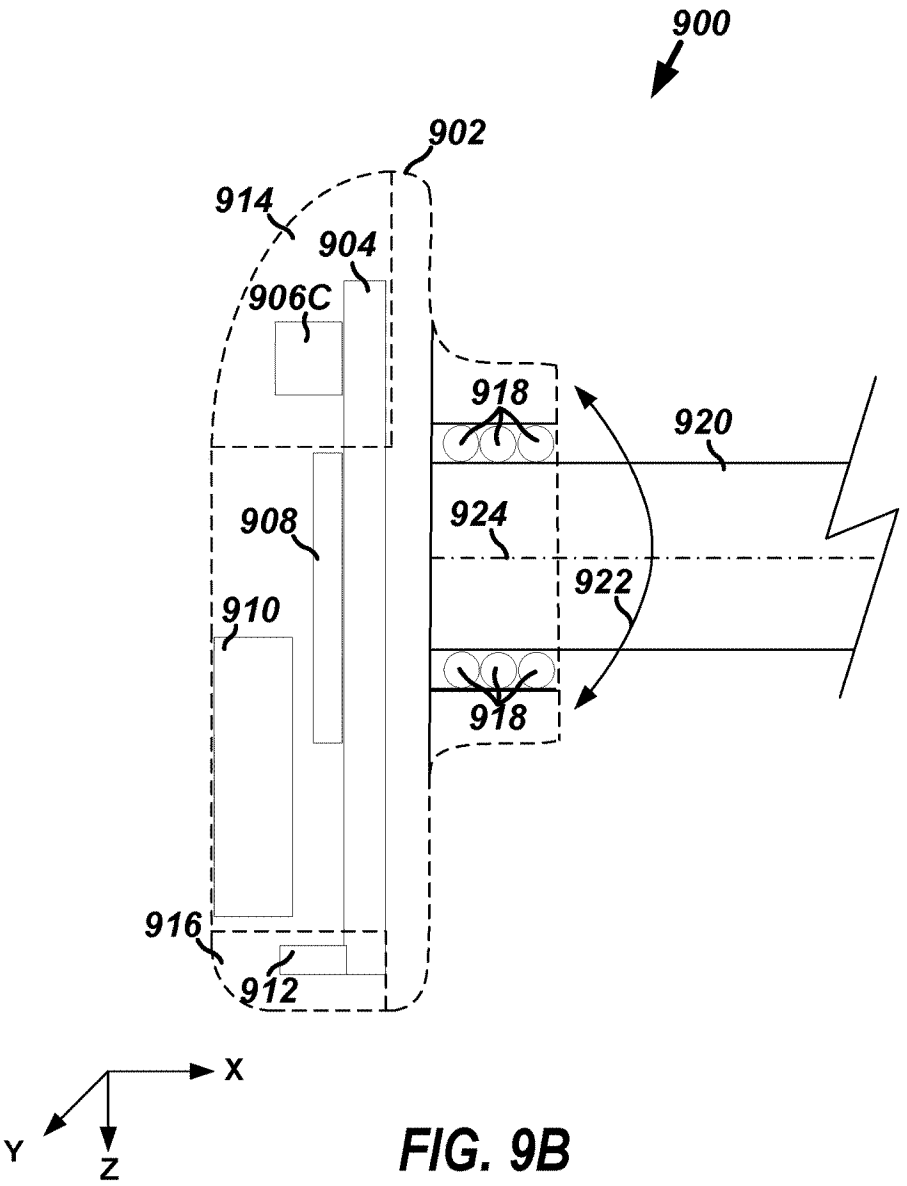
FIG. 9B illustrates, by way of example, another perspective view diagram of the embodiment of the smart pin of FIG. 9A from the arrows labelled "9B".
Figure 9A:
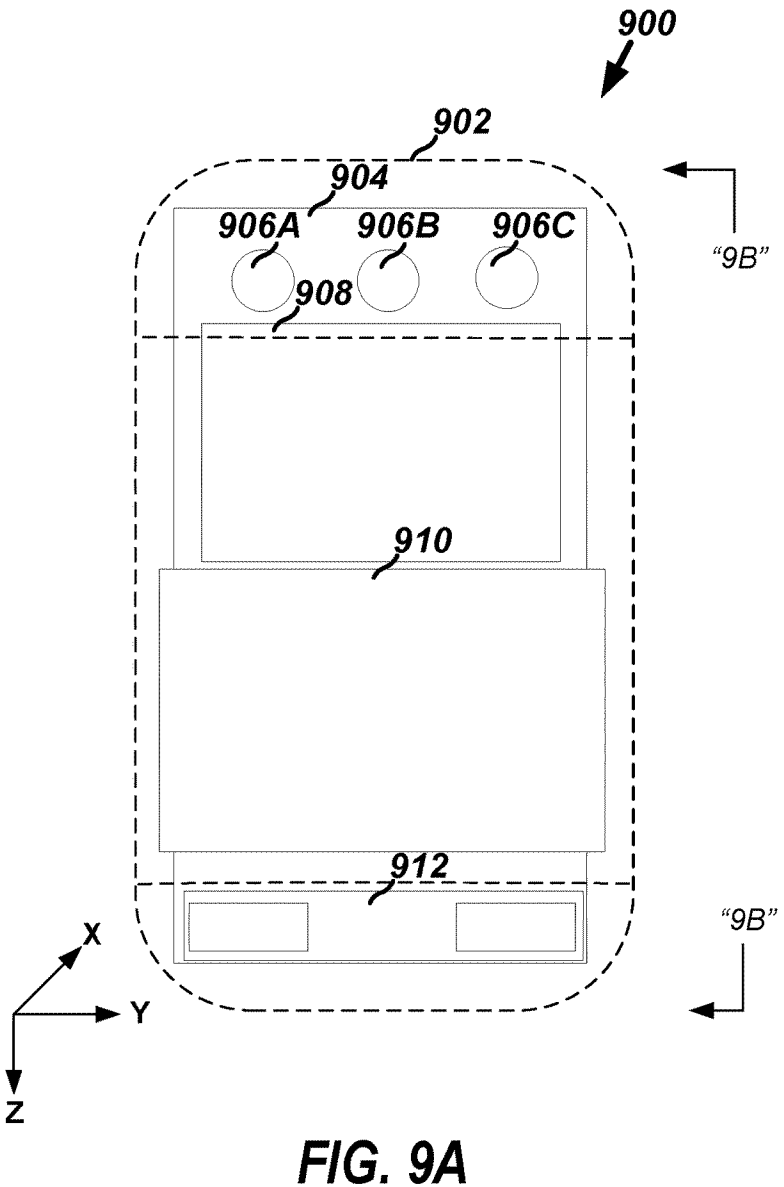
FIG. 9A illustrates, by way of example, a perspective view diagram of another embodiment of a smart pin.

FIG. 9A illustrates, by way of example, a perspective view diagram of another embodiment of a smart pin 900. The perspective illustrated is generally perpendicular to a longitudinal axis of a pin shaft 920 (see FIG. 9B). FIG. 9B illustrates, by way of example, another perspective view diagram of the embodiment of the smart pin of FIG. 9A from the arrows labelled "9B". The pin 900, as illustrated, includes a protection container 902 (e.g., housing), a circuit board 904, LEDs 906A, 906B, and 906C, circuitry 908, a battery 910, and a time of flight (TOF) sensor 912.

The container 902 is illustrated in dashed lines to show a view of components in the container 902. The container 902 can be made of plastic, wood, metal, ceramic, a polymer, a combination thereof, or the like. The container 902 can provide protection to the components (e.g., the circuit board 904, LEDs 906A, 906B, and 906C, circuitry 908, battery 910, and the time of flight (TOF) sensor 912) therein from an environment external to the container 902. For example, the container 902 can protect from physical impact, moisture, dust or other debris, or the like.

The container 902 as illustrated in FIG. 9B includes two transparent regions 914 and 916. The transparent region 914 allows the LEDs 906A-906C to be visible outside the container 902. The transparent region 916 allows a ranging emission (e.g., ranging laser, an RF transmission, or sound wave) produced by the TOF sensor 912 to exit the container 902 and return to the TOF sensor 912. The transparent region 916 may also include perforations or a slot through which a sound wave may be transmitted and received by the TOF sensor 912. Thus, transparent may be in terms of optical transparency or audio transparency.

The circuit board 904 can be an FR-4 or other rigid circuit board. The circuit board 904 can provide mechanical support for the components thereon. The circuit board 904 can include pads to which to electrically connect components. The circuit board 904 can include traces that transport electrical signals between components on the circuit board 904.

The LEDs 906A-906C produce light at a specified wavelength. In various embodiments, LEDs 906A-906C and transparent region 914 are selected to improve or maximize user visibility. The LEDs 906A-906C are specific examples of the optical element(s) 290.

The circuitry 908 controls the operation of the LEDs 906A-906B. The circuitry 908 receives signals from the TOF sensor 912 or other components to determine motion, position, or other characteristics of a workout associated with a weight plate in which the pin 900 is situated. The circuitry 908 can include one or more of the radio 210, speaker 220, weight sensor(s) 230, button(s) 240, the processing circuitry 250, recharge/harvest circuitry 255, movement sensor(s) 260, RFID reader 265, RFID tag 275, microphone 280, I/O port 295, or another circuitry discussed herein.

The battery 910 is a direct current (DC) electric power supply. The battery 910 provides electric power to the circuitry 908, the LEDs 906A-906C, the TOF sensor 912, or other electric or electronic components. The battery 910 can include a lithium-ion (Li-ion), Li-Ion polymer, lead-acid, nickel-cadmium (NiCad), nickel-metal hydride (NiMH), or the like. The battery 910 may be charged by the recharge/harvest circuitry 255, such as can include radio, inductive, or resonance charging.

The TOF sensor 912 produces ranging emissions, receives reflections of the produced emissions, and produces digital values indicative of a time between the produced emission and the received reflection. The digital values are used by the circuitry 908 to determine a distance between the TOF sensor 912 and a surface 1006 (see FIG. 10). More details regarding the TOF sensor 912 operation are provided regarding FIG. 10 and elsewhere herein.

Bearing 918, or another device that allows the container 902 to rotate about a shaft 920 of the pin 900 (e.g., axial rotation), can be housed within the container 902. Various types of bearings may be used, such as a plain bearing, a rolling-element bearing, a jewel bearing, a fluid bearing, a magnetic bearing, and a flexure bearing. The bearing 918 constrains the motion of the container 902 to rotate around the shaft 920 of the pin 900, such as in a direction indicated by arrows 922. The bearings 918 may be formed from metal (e.g., steel, bronze, or the like), ceramic, plastic (e.g., nylon, polytetrafluorethylene, polyoxymethylene, or the like), glass, sapphire, or a combination thereof, among others.

A center of mass may be selected and positioned to maintain an orientation of the container 902. In various embodiments, the center of mass of the battery 910, another component in or on the container 902, or of all the components in or on the container 902 and the container 902 can be positioned off an axis 924 through a center of the shaft 920. The center of mass will rotate the container, by the bearing 918, so that the center of mass of the container 902 and components therein/thereon are offset from the axis 924 in a z-direction.

Figure 10:
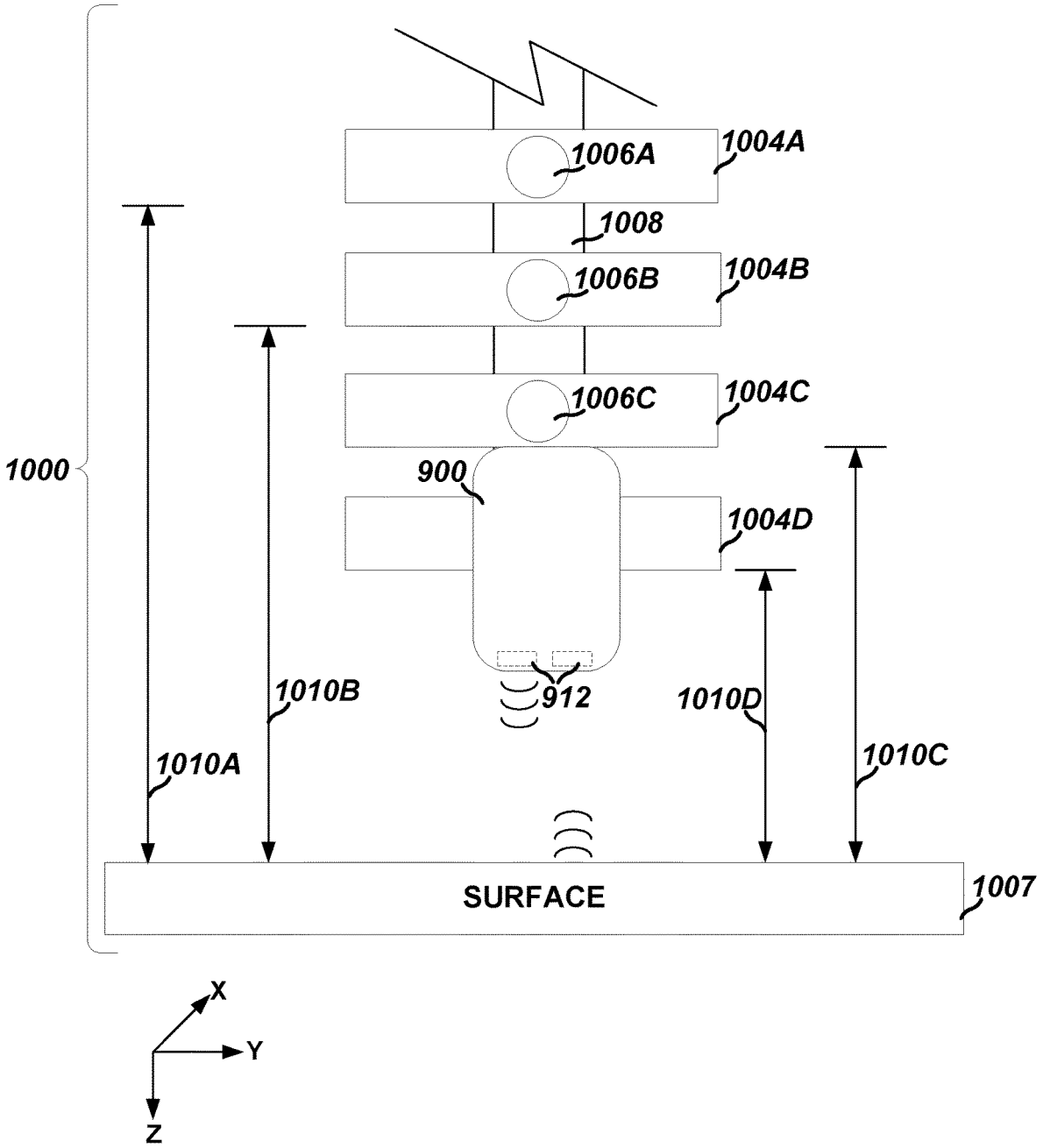
FIG. 10 illustrates, by way of example, a diagram of an embodiment of a portion of a smart pin and weights of a workout monitoring system.

FIG. 10 illustrates, by way of example, a diagram of an embodiment of a portion of a system 1000 including the smart pin 900 and weights 1004A, 1004B, 1004C, and 1004D. The system 1000 includes the smart pin 900, weights 1004A-1004D, and a surface 1006. Each of the weights 1004A-1004D include respective holes 1006A, 1006B, and 1006C (note that the hole in the weight 1004D is occluded by the pin 900) in which the pin 900 can be situated.

The center of mass of the container 902 (and contents therein/thereon) can cause the TOF sensor 912 maintain a preferred orientation. In the example of FIG. 10, the TOF sensor 912 faces a surface 1007 (e.g., in the z-direction). The surface 1007 can be a surface of a floor, a surface of an object attached to a weight machine that includes the weights 1004A-1004D, or the like. The surface 1007 can include a material known to efficiently reflect ranging emissions provided by the TOF sensor 912.

The TOF sensor 912 may be used to determine the selected weight. The time it takes a ranging emission produced by the TOF sensor 912 to reflect back to the TOF sensor 912 can be different when the pin 900 is in the hole of the weight 1004D as compared to when the pin 900 is in the hole 1006A-1006C, respectively. That is, a distance indicated by arrow 1010A, arrow 1010B, arrow 1010C, and arrow 1010D are distinguishable by the TOF sensor 912. The TOF sensor 912 will produce a different value for each of the distances corresponding to arrows 1010A-1010D, respectively.

The circuitry 908 can receive the values produced by the TOF sensor 912 and discern the hole 1006A-1006C in which pin 900 is inserted, and identify the corresponding weight 1004A-1004D. The circuitry 908 can include a memory that includes respective weight numbers (e.g., unique identifiers, such as universally unique identifiers (UUIDs)) indexed by distances or ranges of distances. In response to determining, by the movement sensor(s) 260, that the pin 900 is at rest for a specified amount of time, the values from the TOF sensor 912 can be interpreted by the circuitry 908 to determine in which hole 1006A-1006C the pin 900 is inserted. More detail regarding the determination of the weight in which the pin 900 is situated is provided regarding FIG. 11.

Figure 11:
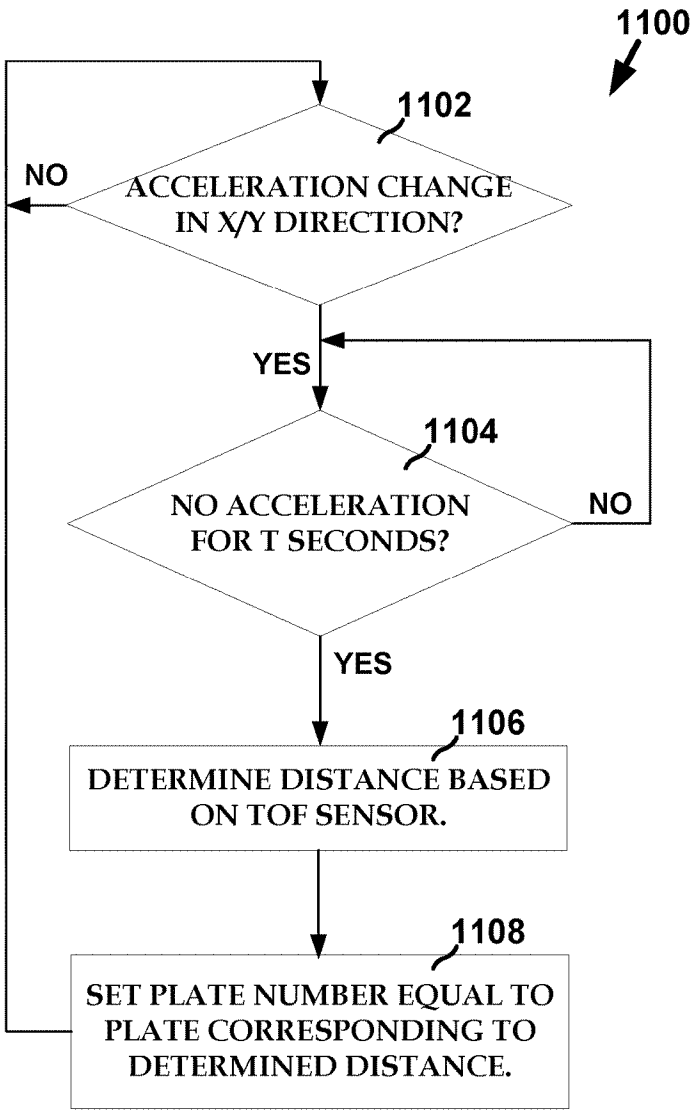
FIG. 11 illustrates, by way of example, a diagram of an embodiment of a method for determining a plate number of a plate in which a smart pin is situated.

FIG. 11 illustrates, by way of example, a diagram of an embodiment of a method 1100 for determining a plate number of a weight plate in which a smart pin is situated. The method 1100 begins at operation 1102 with determining whether an acceleration of the smart pin has changed in an X or Y direction. The X and Y directions are both perpendicular to each other and to a direction (e.g., Z-direction) in which the weight plates move on the weight machine in normal operation. Movement in the X or Y direction (e.g., a change in acceleration in the X or Y direction) is an indication that the pin 900 is being removed from or inserted into another weight plate. A detection of a change in the rotation of the pin 900 may also be used to identify that the pin 900 is being moved from one weight plate to another weight plate.

In some machines, there can be some non-zero acceleration in the X or Y direction during normal use of the machine. To account for this motion, the operation 1102 can include comparing a distance traveled in the X or Y direction (based on the acceleration change data) to a threshold. If the determined distance traveled is greater than the threshold, the pin can be determined to have an acceleration change in the X or Y direction at operation 1102.

In response to determining, at operation 1102, that the acceleration has changed in the X or Y direction, operation 1104 can be performed. In response to determining, at operation 1102, that the acceleration has not changed in the X or Y direction, the operation 1102 can be performed again.

At operation 1104, it can be determined whether the pin is stationary for a specified amount of time (e.g., T seconds). Either of operations 1102 or 1104 can be performed by circuitry interpreting output of an accelerometer or other movement sensor. In response to determining, at operation 1104, that there was no acceleration for the specified period of time, operation 1106 can be performed. In response to determining, at operation 1104, that there was acceleration in the last T seconds, the operation 1104 can be performed again.

At operation 1106, a distance can be determined based a value produced by the TOF sensor. The operation 1106 can be performed by one or more components of the circuitry 908. At operation 1108, a plate number corresponding to a distance (e.g., as indexed in the memory of the circuitry 908) can be set according to the determined distance. The method 1100 can re-start after operation 1108. In various embodiments, method 1100 may be used with one or more spring-loaded retainers to determine when pin 900 is at rest within a weight plate or is being moved between weight plates.

Figure 12:
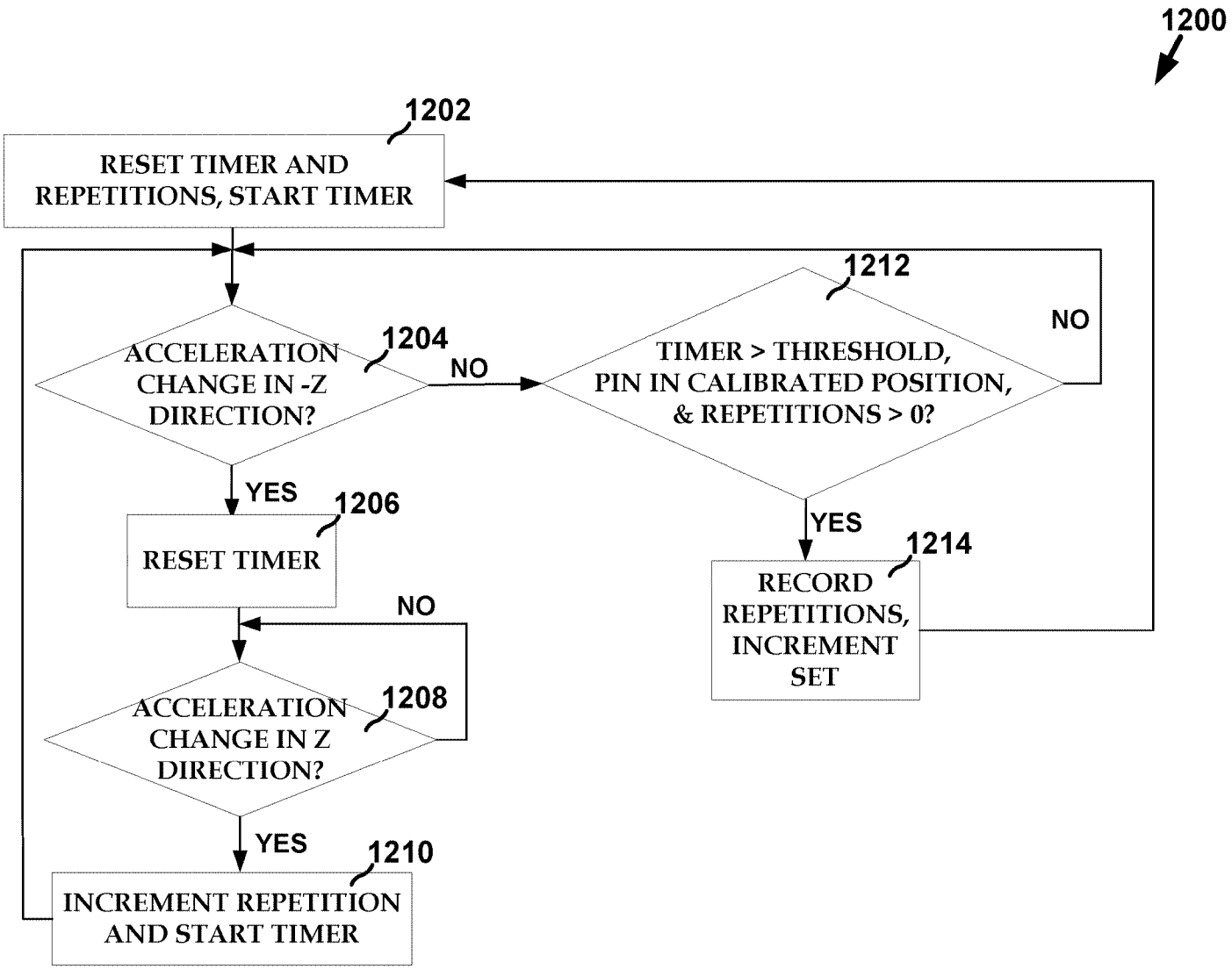
FIG. 12. illustrates, by way of example, a diagram of an embodiment of a method for determining a number of repetitions and an end of a set.

FIG. 12. illustrates, by way of example, a diagram of an embodiment of a method 1200 for determining a number of repetitions and an end of a set. The method 1200 begins at operation 1202. The operation 1202 is an initialization of a timer (e.g., implemented by the circuitry 908) and an initialization of a repetitions count variable (e.g., in the memory). The operation 1202 includes resetting the timer, setting repetitions equal to zero, and starting the reset timer.

At operation 1204, it is determined whether there is an acceleration change in a +Z or −Z direction (e.g., a vertical movement without sufficient acceleration in a X or Y direction, such as at operation 1102). The Z direction is generally perpendicular to the axis 924 and is a direction in which the weight plates move during normal operation. In response to determining there is an acceleration change in the Z direction, operation 1206 can be performed. In response to determining there is no acceleration change in the Z direction, the operation 1212 can be performed.

At operation 1206, the timer can be reset. A movement in the Z direction (e.g., without sufficient movement in a X or Y direction) is an indication that repetition is being executed. The timer can be to determine when a set is completed. A set will be deemed completed when all conditions of operation 1212 are met.

At operation 1208, it is determined whether there is an acceleration change in the +Z direction. This is the direction which the weight plate moves in returning to a start position. In response to determining, at operation 1208, the acceleration has changed in the Z-direction, operation 1210 can be performed. In response to determining, at operation 1208, the acceleration has not changed in the Z-direction, operation 1208 can be performed.

At operation 1210, a repetition counter can be incremented. The operation 1210 is only performed after acceleration is detected in the −Z direction and an acceleration is detected in the +Z direction. These accelerations correspond to the weight plate moving upward and downward, respectively, indicating a repetition. The operation 1204 can be performed in response to the operation 1210.

The operation 1212 includes determining whether three conditions are met. The conditions are whether the timer is greater than a threshold time, the pin is in a position corresponding to one of the distances corresponding to arrows 1010A-1010D (e.g., a calibrated position), and a repetition counter is non-zero. If the three conditions are met, an operation 1214 can be performed. If the three conditions are not met, the operation 1204 can be performed.

The state of pin 900 may be determined by various combinations of conditions. In an example, when the timer is greater than a threshold, the pin is in a calibrated position, and repetitions equals zero. In this example, the pin is at rest in the machine and no user is currently using the machine to perform a workout. In another example, when the timer is greater than a threshold, the pin is a non-calibrated position, and repetitions is greater than zero. In this example, the user has paused their motion or is taking an unusually long amount of time to complete a repetition. This could also mean that the pin needs calibration. In yet another example, the timer is less than a threshold, the pin is in a calibrated position, and repetitions is greater than zero. In this example, the user has just completed a repetition and is about to form another repetition, or that the set has ended. The timer helps ensure that the proper number of repetitions are recorded per set.

Figure 13:
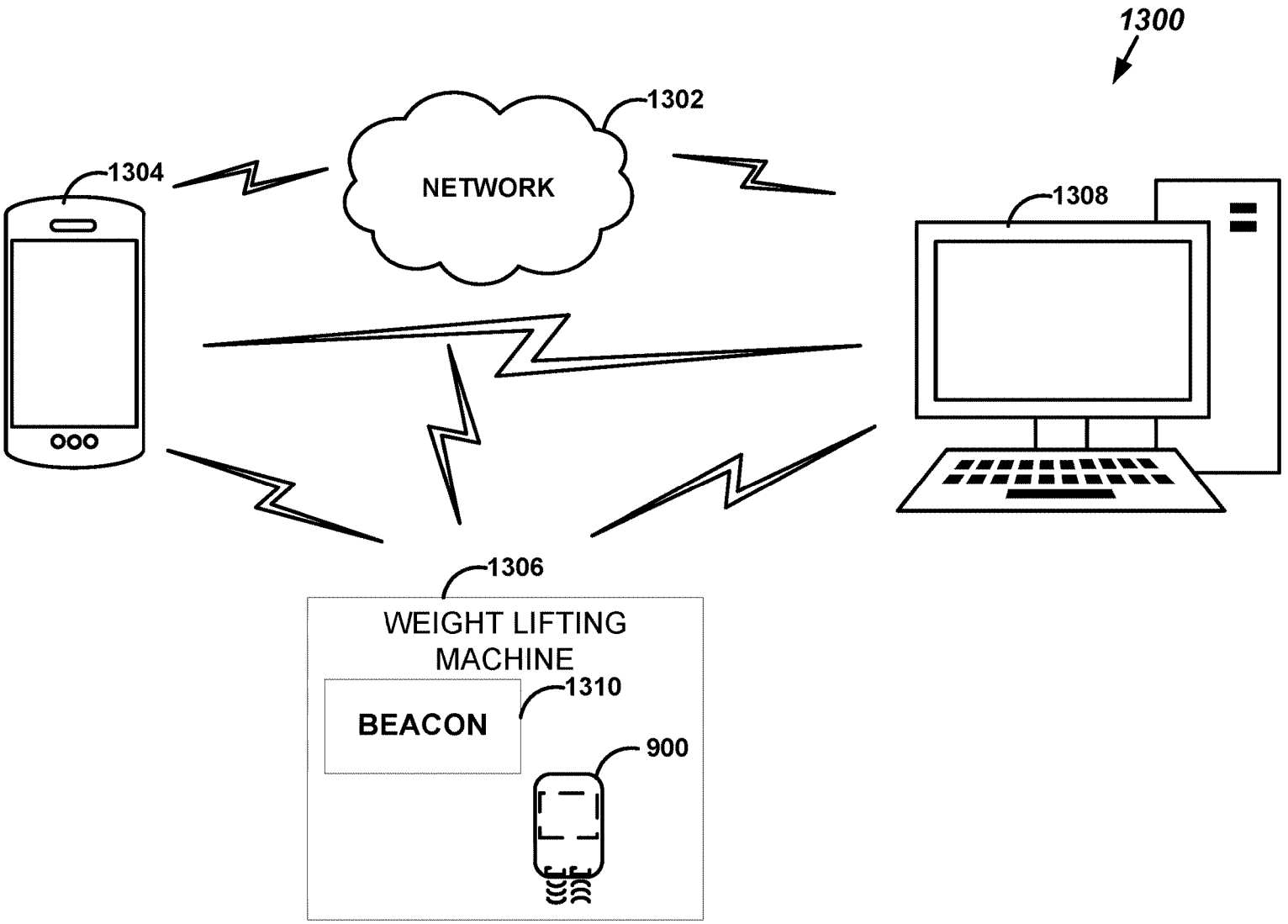
FIG. 13 illustrates, by way of example, a diagram of an embodiment of a system for tracking a workout.

FIG. 13 illustrates, by way of example, a diagram of an embodiment of a system 1300 for tracking a workout. The system 1300 as illustrated includes a network 1302, a mobile device 1304, a weight lifting machine 1306, and a server 1308.

The network 1302 can be a local area network (LAN), wide area network (WAN), or the like. The network 1302, in one or more embodiments can include the Internet. The can provide a communication medium over which the pin 900, mobile device 1304, weight lifting machine 1306, or server 1308 can communicate. The communications between the pin 900, mobile device 1304, weight lifting machine 1306, or server 1308 can include packets of data. The packets of data can indicate a date, time, repetitions, weight lifting machine identification, weight plate identification, or the like.

The mobile device 1304 can include a smart phone, tablet, phablet, or the like. The mobile device 1304 can include an app operating thereon that interprets packets from the pin 900 or a beacon 1310 of the weight lifting machine 1306. The beacon 1310, in one or more embodiments, can include a Bluetooth beacon, or the like. A user can situate the mobile device 1304, with the app executing thereon, sufficiently close to the weight lifting machine 1306 (e.g., such that a received signal strength is greater than, or equal to, a threshold value). The app can cause the mobile device 1304 to interpret the beacon 1310 and determine an identification of the weight lifting machine 1306 (e.g., weight lifting machine identification).

The mobile device 1304, through execution of the app, can receive data from the pin 900 regarding the number of repetitions in a set, a weight plate identification (or an amount of weight associated with a weight plate), an amount of time in performing the set, or the like. The mobile device 1304 can include a user interface through which a user can provide various inputs or be presented with various outputs, such as output graphs, charts, tables, or other presentations of their current workout or past workout(s). In this manner, the mobile device 1304 can track a user's workouts over time.

The server 1308 can receive workout data from the pin 900 or mobile device 1304, such as over the network 1302. The server 1308 can include a computer, memory, one or more applications operating thereon, or the like. The server 1308 can record data regarding usage of the weight lifting machine 1306, a user usage of the weight lifting machine 1306, user workout data, or the like. The data can include a user identification, a weight lifting machine identification, a weight plate identification, a number of repetitions, a number of sets, a date of usage, a time of usage, a duration of usage, or the like. Using the data, a proprietor of the facility in which the weight lifting machine 1306 is situated can be informed of which equipment gets used, which equipment is not used or is under-used, when to replace or repair equipment, or the like.

Figure 14:
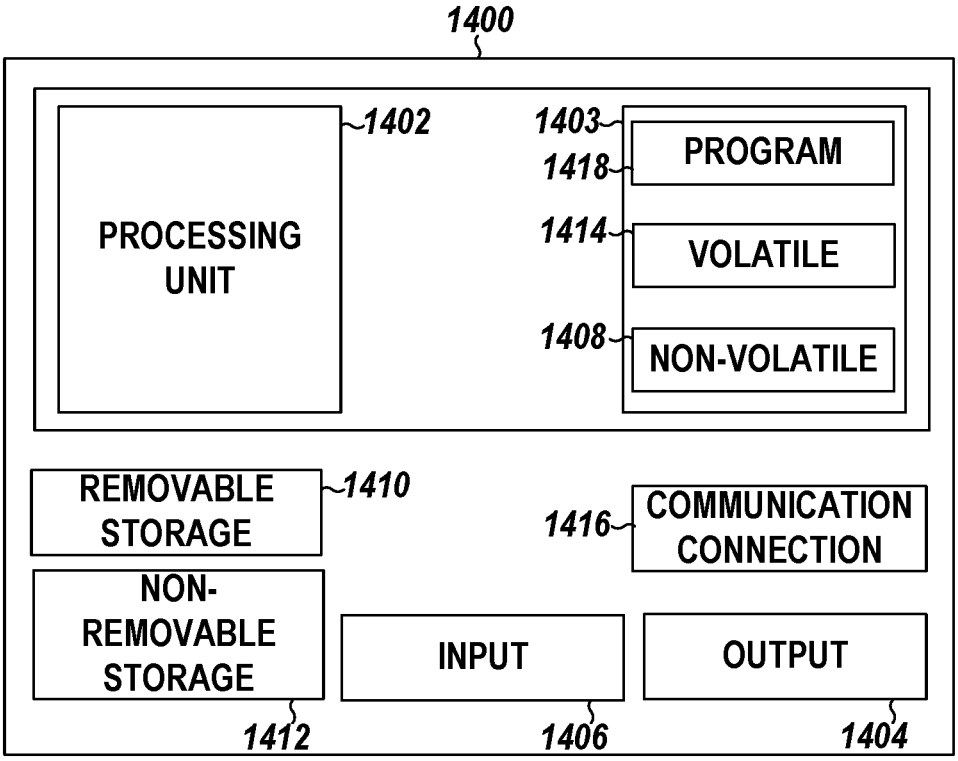
FIG. 14 is a block schematic diagram of a machine (e.g., a computer system) to implement operations of a smart weight-lifting device.

FIG. 14 is a block schematic diagram of a machine 1400 (e.g., a computer system) to implement operations of a smart weight-lifting device. One example machine 1400 (in the form of a computer), may include a processing unit 1402, memory 1403, removable storage 1410, and non-removable storage 1412. Although the example computing device is illustrated and described as machine 1400, the computing device may be in different forms in different embodiments. For example, the computing device may be a part of a smartphone, a tablet, smartwatch, smart weight-lifting device or other computing device including the same or similar elements as illustrated and described regarding FIGS. 1-13. Devices such as smartphones, tablets, and smartwatches are generally collectively referred to as mobile devices. Further, although the various data storage elements are illustrated as part of the machine 1400, the storage may also or alternatively include cloud-based storage accessible via a network, such as the Internet.

Memory 1403 may include volatile memory 1414 and non-volatile memory 1408. The machine 1400 may include—or have access to a computing environment that includes—a variety of computer-readable media, such as volatile memory 1414 and non-volatile memory 1408, removable storage 1410 and non-removable storage 1412. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices capable of storing computer-readable instructions for execution to perform functions described herein.

The machine 1400 may include or have access to a computing environment that includes input 1406, output 1404, and a communication connection 1416. Output 1404 may include a display device, such as a touchscreen, that also may serve as an input device, such as shown on end of the pin 100/300 in FIG. 4, in the container 902, or on the mobile device 1304 or server 1308. The input 1406 may include one or more of a touchscreen, touchpad, mouse, keyboard, camera, one or more device-specific buttons, one or more sensors integrated within or coupled via wired or wireless data connections to the machine 1400, and other input devices, such as shown on end of the pin 100/300 in FIG. 4, in the container 902, or on the mobile device 1304 or server 1308. The computer may operate in a networked environment using a communication connection to connect to one or more remote computers, such as database servers, including cloud based servers and storage. The remote computer may include a personal computer (PC), server, router, network PC, a peer device or other common network node, or the like. The communication connection may include a Local Area Network (LAN), a Wide Area Network (WAN), cellular, Institute of Electrical and Electronics Engineers (IEEE) 802.11 (Wi-Fi), Bluetooth, or other networks.

Computer-readable instructions stored on a computer-readable storage device are executable by the processing unit 1402 of the machine 1400. A hard drive, CD-ROM, and RAM are some examples of articles including a non-transitory computer-readable medium such as a storage device. For example, a computer program 1418 may be used to cause processing unit 1402 to perform one or more methods or algorithms described herein.

Although a few embodiments have been described in detail above, other modifications are possible. For example, the logic flows depicted in the figures do not require the order shown, or sequential order, to achieve desirable results. Other steps may be provided, or steps may be eliminated, from the described flows, and other components may be added to, or removed from, the described systems. Other embodiments may be within the scope of the following claims.

What is claimed is:

1. A weight-lifting pin configured for insertion into a weight plate of a weight-lifting machine, the weight-lifting pin comprising:

a shaft including a first portion configured for insertion into a weight plate;

a wireless transmitter;

a time of flight sensor;

a movement sensor; and processing circuitry to determine a number of repetitions performed using the weight-lifting machine and a weight plate identification of the weight plate in which the weight-lifting pin is situated based on data from the time of flight sensor and the movement sensor; wherein the weight-lifting pin includes a container coupled to a second portion of the shaft opposite the first portion, the container housing the movement sensor, the processing circuitry, the wireless transmitter, and the timer of flight sensor; wherein the container includes a first transparent portion and wherein the time of flight sensor is positioned in the container to direct waves through the first transparent portion.

2. The weight-lifting pin of claim 1, wherein the determination of the number of repetitions performed using the weight-lifting machine includes the processing circuitry to:

detect, based on data from the movement sensor, an acceleration change in a −Z-direction perpendicular to a surface of the weight plate;

detect, based on data from the movement sensor, an acceleration change in a +Z-direction opposite the −Z-direction; and increment a repetition counter.

3. The weight-lifting pin of claim 2, wherein the processing circuitry is further to determine when a set is complete by:

in response to determining that there is no acceleration change in the −Z direction, determine whether a timer value of a timer of the processing circuitry is greater than a threshold value, whether the weight-lifting pin is in a position indexed in a memory of the processing circuitry, and whether the repetition counter is greater than zero; and in response to determining that the timer value is greater than the threshold value, the pin is in a position indexed in a memory of the processing circuitry, and the repetition counter is greater than zero, determine the set has ended and record the repetitions in the memory.

4. The weight-lifting pin of claim 3, wherein the determination of the weight plate identification of the weight plate in which the weight-lifting pin includes the processing circuitry to:

detect, based on data from the movement sensor, an acceleration change in an XY plane parallel to a plane of a surface of the weight plate;

detect, based on data from the movement sensor, that no acceleration has occurred for a specified amount of time;

determine, based on data from the time of flight sensor, a distance between the time of flight sensor and a surface; and set the weight plate identification to a weight plate number based on the determined distance.

5. The weight-lifting pin of claim 4, wherein the wireless transmitter is to transmit, the number of repetitions and the weight plate identification to a mobile device or a server in response to determining the set has ended.

6. The weight-lifting pin of claim 1, further comprising one or more optical elements in the container, the optical elements to produce light indicating a state of processing circuitry or an action to be performed by a user of the weight-lifting pin.

7. The weight-lifting pin of claim 6, wherein the container further comprises a second transparent portion and wherein the one or more optical elements are situated to direct light through the second transparent portion.

8. The weight-lifting pin of claim 1, further comprising:

a battery situated in the container and electrically coupled to the movement sensor, the processing circuitry, the wireless transmitter, and the time of flight sensor; and a bearing situated between the container and the shaft to constrain a motion of the container to motion about a longitudinal axis of the shaft.

9. The weight-lifting pin of claim 8, wherein the battery is situated in the container with its center of mass off the longitudinal axis of the shaft to orient the time of flight sensor in a specific direction.

10. The weight-lifting pin of claim 1, further comprising recharge circuitry to provide electrical power to the battery.

11. A weight-lifting pin configured for insertion into a weight plate of a weight-lifting machine, the weight-lifting pin comprising:

a shaft including a first portion configured for insertion into a weight plate;

a wireless transmitter;

a time of flight sensor;

a movement sensor;

one or more optical elements, the optical elements to produce light indicating a state of processing circuitry or an action to be performed by a user of the pin processing circuitry to determine a number of repetitions performed using the weight-lifting machine and a weight plate identification of the weight plate in which the weight-lifting pin is situated based on data from the time of flight sensor and the movement sensor; and a container coupled to a second portion of the shaft opposite the first portion, the container housing the movement sensor, the processing circuitry, the wireless transmitter, the optical elements, and the time of flight sensor, wherein the container includes a first transparent portion and wherein the time of flight sensor is positioned in the container to direct waves through the first transparent portion, wherein the container further comprises a second transparent portion and wherein the one or more optical elements are situated to direct light through the second transparent portion;

a battery situated in the container and electrically coupled to the movement sensor, the processing circuitry, the wireless transmitter, and the time of flight sensor; and a bearing situated between the container and the shaft to constrain a motion of the container to motion about a longitudinal axis of the shaft, wherein the battery is situated in the container with its center of mass off the longitudinal axis of the shaft to orient the time of flight sensor in a specific direction.

12. The weight-lifting pin of claim 11, wherein:

the determination of the number of repetitions performed using the weight-lifting machine includes the processing circuitry to:

detect, based on data from the movement sensor, an acceleration change in a −Z-direction perpendicular to a surface of the weight plate;

detect, based on data from the movement sensor, an acceleration change in a +Z-direction opposite the −Z-direction; and increment a repetition counter, the processing circuitry is further to determine when a set is complete by:

in response to determining that there is no acceleration change in the −Z direction, determine whether a timer value of a timer of the processing circuitry is greater than a threshold value, whether the weight-lifting pin is in a position indexed in a memory of the processing circuitry, and whether the repetition counter is greater than zero; and in response to determining that the timer value is greater than the threshold value, the pin is in a position indexed in a memory of the processing circuitry, and the repetition counter is greater than zero, determine the set has ended and record the repetitions in the memory.

13. The weight-lifting pin of claim 12, wherein the determination of the weight plate identification of the weight plate in which the weight-lifting pin includes the processing circuitry to:

detect, based on data from the movement sensor, an acceleration change in an XY plane parallel to a plane of a surface of the weight plate;

detect, based on data from the movement sensor, that no acceleration has occurred for a specified amount of time;

determine, based on data from the time of flight sensor, a distance between the time of flight sensor and a surface; and set the weight plate identification in the memory to a weight plate number based on the determined distance, wherein the wireless transmitter is to transmit, the number of repetitions and the weight plate identification to a mobile device or a server in response to determining the set has ended.

14. The weight-lifting pin of claim 11, further comprising inductive recharge circuitry to provide electrical power to the battery.

15. A method performed by processing circuitry of a pin configured for insertion into a weight plate of a weight-lifting machine, the pin comprising: a shaft including a first portion configured for insertion into the weight plate; a wireless transmitter; a time of flight sensor; a movement sensor; the processing circuitry to determine a number of repetitions performed using the weight-lifting machine and a weight plate identification of the weight plate in which the weight-lifting pin is situated based on data from the time of flight sensor and the movement sensor; a container coupled to a second portion of the shaft opposite the first portion, the container housing the movement sensor, the processing circuitry, the wireless transmitter, and the timer of flight sensor; wherein the container includes a first transparent portion and wherein the time of flight sensor is positioned in the container to direct waves through the first transparent portion, the method comprising:

detecting, based on data from the movement sensor of the pin, whether there is an acceleration change in a −Z-direction perpendicular to a surface of the weight plate;

in response to detecting an acceleration in the −Z-direction, detecting, based on data from the movement sensor, whether there is an acceleration change in a +Z-direction opposite the −Z-direction; and in response to detecting the acceleration change in the +Z-direction, incrementing a repetition counter in a memory of the pin.

16. The method of claim 15, further comprising:

in response to determining that there is no acceleration change in the −Z direction, determine whether a timer value of a timer of the processing circuitry is greater than a threshold value, whether the pin is in a position indexed in a memory of the processing circuitry, and whether the repetition counter is greater than zero; and in response to determining that the timer value is greater than the threshold value, the pin is in a position indexed in a memory of the processing circuitry, and the repetition counter is greater than zero, determine the set has ended and record the repetitions in the memory.

17. The method of claim 16, further comprising:

detecting, based on data from the movement sensor, whether there is an acceleration change in an XY plane parallel to a plane of a surface of the weight plate;

in response to detecting there is an acceleration change in the XY plane, detecting, based on data from the movement sensor, whether no acceleration has occurred for a specified amount of time;

in response to detecting no acceleration has occurred for a specified amount of time, determine, based on data from the time of flight sensor, a distance between the time of flight sensor and a surface; and set the weight plate identification in the memory to a weight plate number based on the determined distance.

18. The method of claim 17, further comprising transmitting, by a wireless transmitter of the pin, the number of repetitions and the weight plate identification to a mobile device or a server in response to determining the set has ended.

* * * * *